US008219003B2

(12) United States Patent
Kudo et al.

(10) Patent No.: US 8,219,003 B2
(45) Date of Patent: Jul. 10, 2012

(54) DRIVE CONTROL DEVICE OF A ROTATION MEMBER, METHOD FOR DRIVE CONTROL OF A ROTATION MEMBER, AND IMAGE FORMING APPARATUS INCLUDING THE DRIVE CONTROL DEVICE

(75) Inventors: Koichi Kudo, Yokohama (JP); Jun Yamane, Yokohama (JP); Takahisa Koike, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 460 days.

(21) Appl. No.: 12/333,010

(22) Filed: Dec. 11, 2008

(65) Prior Publication Data

US 2009/0148185 A1 Jun. 11, 2009

(30) Foreign Application Priority Data

Dec. 11, 2007 (JP) ..... 2007-319630
Oct. 30, 2008 (JP) ..... 2008-279812

(51) Int. Cl.
*G03G 15/00* (2006.01)

(52) U.S. Cl. ..... 399/167; 399/111; 399/159; 399/163

(58) Field of Classification Search ..... 399/107, 399/110, 111, 116, 117, 159, 162–165, 167
See application file for complete search history.

(56) References Cited

U.S. PATENT DOCUMENTS 5,383,014 A * 1/1995 Nowak et al. ..... 356/28
2004/0022557 A1 2/2004 Kudo
2004/0160646 A1 8/2004 Kudo et al.
2004/0228663 A1 11/2004 Kamiya et al.
2005/0151500 A1 7/2005 Akiyama
2005/0180764 A1 8/2005 Koike
2006/0002748 A1 1/2006 Kudo et al.
2006/0110189 A1* 5/2006 Matsuda et al. ..... 399/301
2006/0116228 A1 6/2006 Kamiya et al.
2006/0120740 A1 6/2006 Yamada et al.
2007/0001010 A1 1/2007 Yamane
2007/0007925 A1* 1/2007 Yamane ..... 318/600
2007/0122193 A1* 5/2007 Carolan ..... 399/167
2007/0166075 A1* 7/2007 Funamoto et al. ..... 399/167

FOREIGN PATENT DOCUMENTS

JP 2001-75324 3/2001
JP 2004-53882 2/2004
JP 2006-139217 6/2006
JP 2006-160512 6/2006

* cited by examiner

*Primary Examiner* — David Porta
*Assistant Examiner* — Jessica L Eley
(74) *Attorney, Agent, or Firm* — Oblon, Spivak, McClelland, Maier & Neustadt, L.L.P.

(57) ABSTRACT

A drive control apparatus including a drive motor that transmits a rotation drive force to a rotation member in order to rotate the rotation member, a pulse signal outputting unit that outputs a pulse signal for each predetermined angle of rotation or a position for rotation of the rotation member, while the rotation member is rotating, a pulse cycle measuring unit that measures a pulse cycle of the pulse signal, where the pulse cycle is a cycle of a rising or falling edge, a computation processing unit that computes an angular error or a position error of the rotation member based on the pulse cycle and a desired pulse cycle, where the desired pulse cycle corresponds to a desired velocity of the rotation member and a drive control unit that controls the drive motor based on the angular error or the position error.

5 Claims, 20 Drawing Sheets

DRIVE CONTROL DEVICE OF A ROTATION MEMBER, METHOD FOR DRIVE CONTROL OF A ROTATION MEMBER, AND IMAGE FORMING APPARATUS INCLUDING THE DRIVE CONTROL DEVICE

CROSS-REFERENCE TO RELATED APPLICATIONS

This application is based upon and claims priority under 35 U.S.C. §119 to Japanese Patent Application No. 2007-319630, filed Dec. 11, 2007 and No. 2008-279812, filed, Oct. 30, 2008, the entire contents of which are hereby incorporated by reference.

BACKGROUND OF THE INVENTION

1. Field of the Invention

The present invention generally relates to a drive control device of a rotation member, a method for drive control of the rotation member and an image forming apparatus including the drive control device. More particularly, the disclosed invention relates to a drive control device for appropriately rotating an endless belt member or an electrophotographic photoreceptor, a method for drive control of the same and an image forming apparatus, such as a copier, a printer, or a facsimile machine, which includes the drive control device.

2. Description of the Related Art

Recently, the number of image forming apparatuses such as copiers, printers, etc, that are able to form full-color images using electrophotographic technology, has been increasing along with demand from the market for such apparatuses.

Some of these electrophotographic image forming apparatuses have a plurality of image development devices around a single electrophotographic photoreceptor. In such image forming apparatuses, each of the plurality of image development devices has a respective single-color toner. In addition, this type of image forming apparatus forms a color image by attaching the respective single-color toner onto the latent image on the electrophotographic photoreceptor, and transfers the color image formed on the electrophotographic photoreceptor to the intermediate transferring belt. The full-color image formed on the intermediate transferring belt is then transferred onto a recording medium such as paper or a paper like medium.

Another type of electrophotographic image forming apparatus, called a tandem electrophotographic image forming apparatus, has a plurality of image generation units each comprising an electrophotographic photoreceptor and an image development unit placed in alignment. Each of the image generation units generates a single-color image with respective color toner. In this type of image forming apparatus there are two methods by which the single-color image is transferred onto the recording medium so as to generate a full-color image. One is entitled the "direct transferring method". In this method, every single-color image is successively transferred onto the recording medium, which is supported and delivered by a sheet delivering belt, so as to form a full-color image on the recording medium. The other method is entitled the "indirect transferring method". In this method, every single-color image is successively transferred onto an intermediate transferring belt so as to first form a full-color image on the intermediate transferring belt, then the full-color image is transferred onto a recording medium by a second transferring unit.

In such a color image forming apparatus, multiple color toner images, such as yellow, cyan, magenta, and black, are formed and are successively superimposed by being transferred onto a recording medium or an intermediate transfer belt so as to form a full-color image. As a result, if a displacement of the superimposing position of the multiple color toner images were to occur, color drift or change in color, which degrades the image quality of the full-color image may occur. Therefore, it is important to ensure that the superimposing position is aligned.

One of main causes of displacement of the superimposing position is change in the velocity of the electrophotographic photoreceptor, the electrophotographic photoreceptor belt, the sheet feeding belt or the intermediate transferring belt, etc.

In order to reduce this disadvantageous change in velocity of the electrophotographic photoreceptor, a method has been proposed in which a rotary encoder is coupled to the rotary shaft of the electrophotographic photoreceptor or the rotary shaft of the intermediate transferring belt. In addition, the method includes the calculation of a controlled variable based on a deviation between a rotational velocity of the electrophotographic photoreceptor obtained from the encoder and a desired velocity. Finally, the method includes controlling the rotational velocity of the electrophotographic photoreceptor based on the deviation (see for example Japanese laid-open patent applications 2001-75324 and 2004-53882).

On the other hand, a different method has been proposed in which a rotary encoder is coupled to a rotary shaft of an intermediate transferring belt in order to obtain a rotational velocity signal based on an edge cycle, a count value and an output by the rotary encoder. Further the method includes calculating moving position information of the intermediate transferring belt from a detection signal detected by a mark sensor which detects scales placed on the intermediate transferring belt along with its moving direction at a predetermined interval and calculating desired position data based on the rotational velocity and the moving position information. Finally, the method includes providing feedback on the desired position data from the feedback control system (see for example Japanese laid-open patent application 2006-160512).

Moreover, an additional method has been proposed in which two mark sensors are placed a predetermined distance apart and are used to detect scales placed on an intermediate transferring belt in addition to a moving direction of the intermediate transferring belt at a predetermined interval. Further the method describes calculating a phase shift based on a detection signal of each mark sensor, which is edge cycle and generating a profile indication of pitch error on marks per rotation cycle based on the sequentially-calculated phase shift. In addition, the method includes generating mark pitch correction data for one rotation cycle and adjusting desired position data based on the mark pitch correction data (see for example Japanese laid-open patent application 2006-139217).

Positioning with high accuracy can be accomplished by using a drive control as is mentioned above. However, when using a tandem type color image forming device, for example, it would be necessary to control many rollers so as to obtain an image with high accuracy. Many motors would need to be controlled, such as a number of drive motors for four photosensitive bodies and an intermediate element, a drive motor for a second transferring belt, a drive motor for a fixation belt or a drive motor for a resister roller that determines the head position of paper and delivers the paper or the like. If these drive motors were to be controlled using a CPU, heavy computation would be required. As a result, it would be necessary to use either a plurality of CPUs or a high-speed CPU resulting in significant cost pressure. The drive control of the electrophotography image forming system is the basis of equal velocity control, but it is desirable to use tracking control to a desired ramp function so as to prevent position displacement which causes image and color drift. Using an encoder pulse count as a rotation position for position control has been generally used, but it has been difficult to equip a mass-produced machine with an encoder with high-resolution and high-accuracy. Thus, the method shown in the references has low cost, however, this method also has low resolution requiring high-speed/massive computation in order to compute a velocity from an edge cycle of a pulse output from an encoder.

SUMMARY OF THE INVENTION

One of the objects of the present invention is to provide a drive control apparatus which comprises a drive motor configured to transmit a rotation drive force to a rotation member in order to rotate the rotation member; a pulse signal outputting unit configured to output a pulse signal for each predetermined angle of rotation or a position for rotation of the rotation member, while the rotation member is rotating; a pulse cycle measuring unit configured to measure a pulse cycle of the pulse signal, wherein the pulse cycle is a cycle of a rising or falling edge; a computation processing unit configured to compute an angular error or a position error of the rotation member based on the pulse cycle and a desired pulse cycle, wherein the desired pulse cycle corresponds to a desired velocity of the rotation member; and a drive control unit configured to control the drive motor based on the angular error or the position error.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of an embodiment of the present invention.

Figure 1:
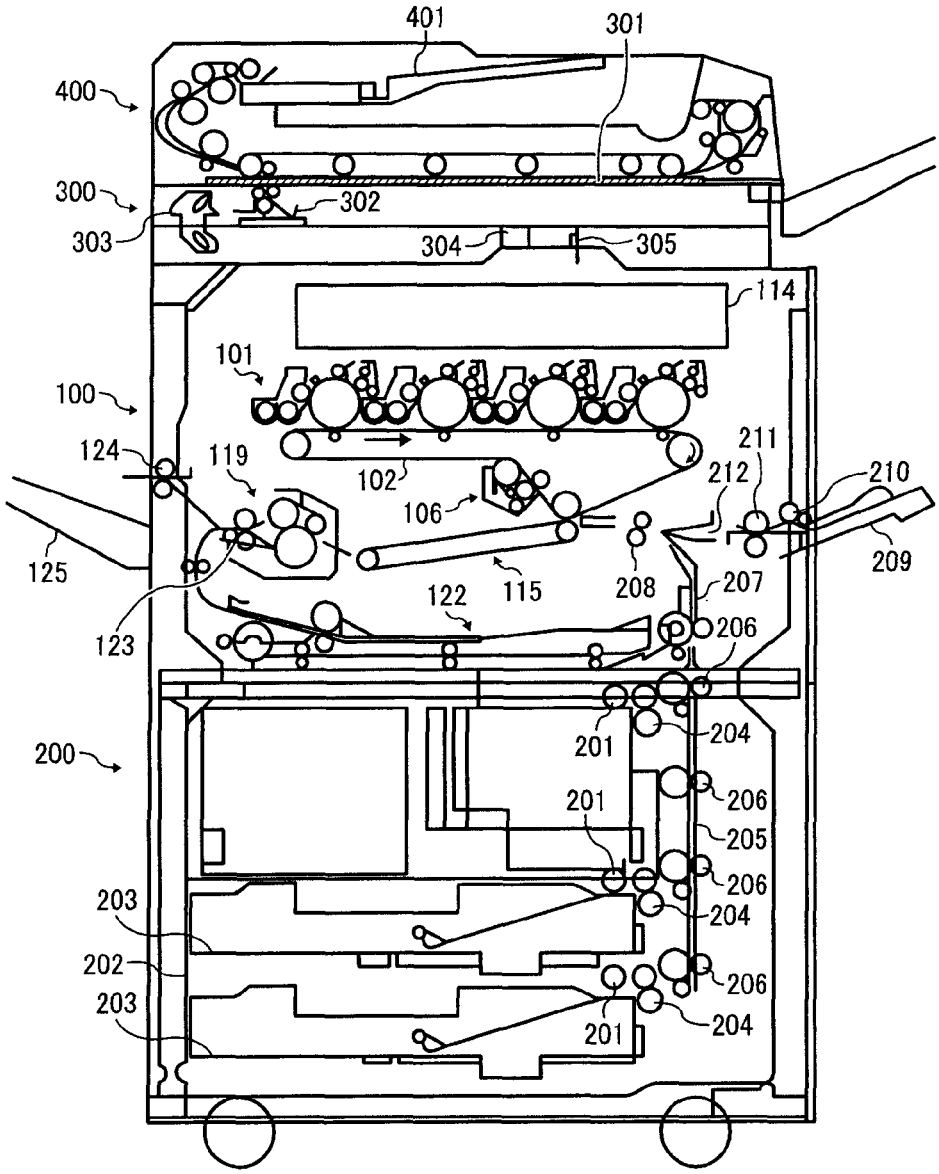
FIG. 1 is a schematic diagram showing an internal configuration of an image forming apparatus according to an embodiment of the present invention.

For example, FIG. 1 is a schematic diagram showing an internal configuration of an image forming apparatus according to an embodiment of the present invention. The image forming apparatus according to this embodiment may be, among other things, a color copier.

The color copier of FIG. 1 is a tandem electrophotographic apparatus. The image forming device 100, as shown in FIG. 1, is disposed above a paper feed unit 200, and a scanner 300 and an automatic paper feeder 400 are disposed above the image forming apparatus 100, where the scanner 300 is arranged directly above the image forming apparatus 100 and the automatic paper feeder (ADF) 400 is placed directly above the scanner 300.

Figure 2:
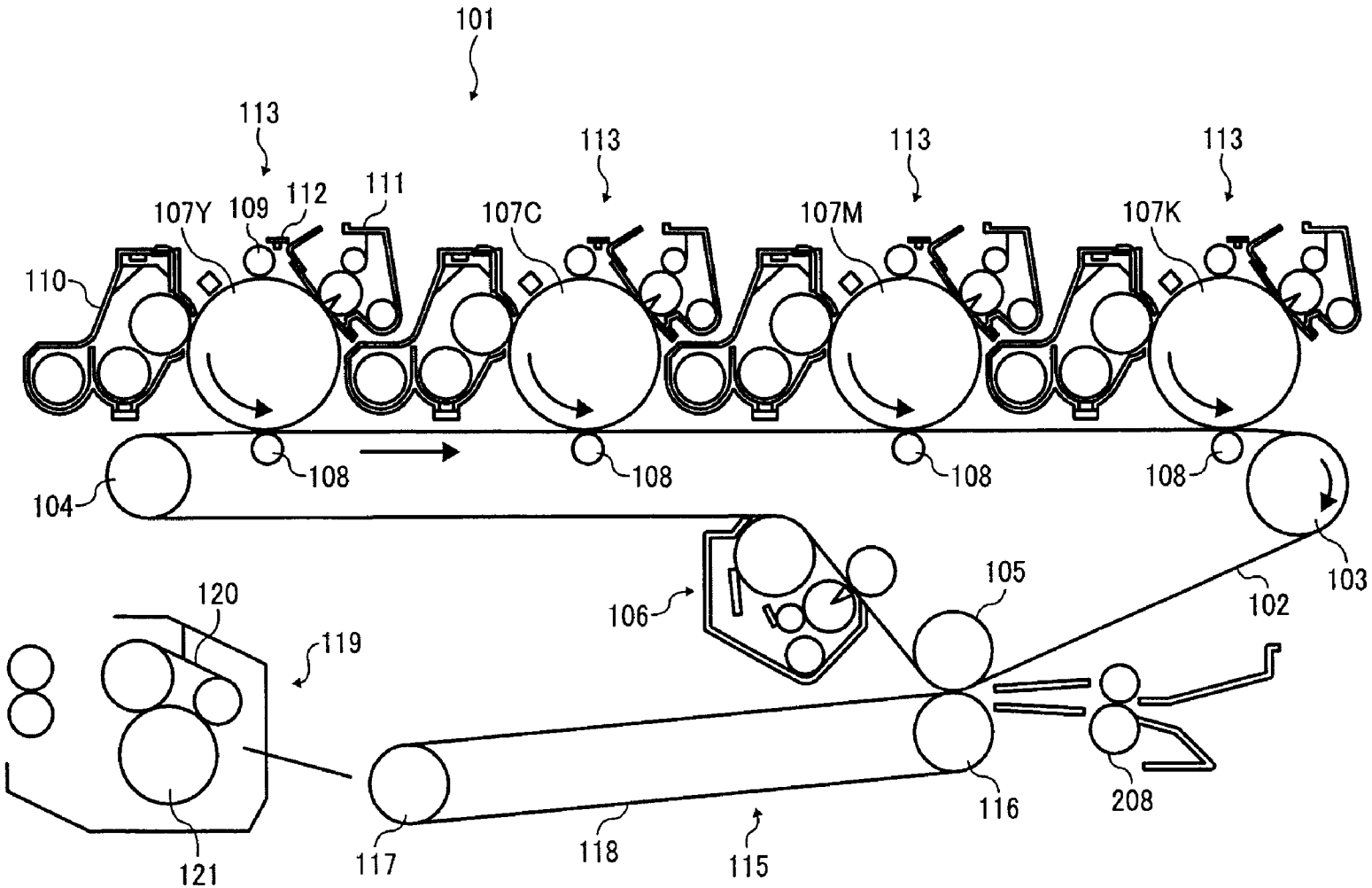
FIG. 2 is a diagram showing a detailed configuration of the printer part shown in FIG. 1 according to an embodiment of the present invention.

The image forming device 100 includes a transferring unit 101. The transferring unit 101, as shown in FIG. 2, includes an intermediate transferring unit 102 (such as an intermediate transferring belt), a drive roller 103 and two driven rollers 104, 105. The intermediate transferring belt 102 is provided to engage the drive roller 103 and as a result, the driven rollers 104, 105 so as to provide rotation in a clockwise rotation.

The residual toner remaining on the surface of the intermediate transferring belt 102 is eliminated by an intermediate transferring belt cleaning unit 106, which is arranged on the left-hand side of the driven roller 105 with respect to the moving direction of the intermediate transferring belt 102.

On the upper side of the linear part of the intermediate transferring belt 102 between the drive roller 103 and the driven roller 104, four drum-like photosensitive bodies 107, yellow (Y), cyan (c) magenta (m) and key/black (k), are spaced at regular intervals. Further, the four first transferring rollers 108 are arranged on the inward side of the intermediate transferring belt so as to interleave the intermediate transferring belt between the drum-like photosensitive bodies and the transferring rollers 108 such that each photosensitive body contacts the roller through the belt.

The four photosensitive bodies are rotatable in a counter clockwise direction as is shown in FIG. 2. A charging unit 109, a first transferring roller, an intermediate transferring belt cleaning unit 111, and a neutralization unit are spaced around each photosensitive body 107 so as to comprise each image forming unit 113. Above the four image forming units 113, an exposure unit 114, commonly used by each image forming unit 113, is disposed.

Each toner image formed on each photosensitive body 107 is directly transferred onto the intermediate transferring belt 102 and a full-color image is formed on the intermediate transferring belt 102 by superimposing the respective images one by one.

As is illustrated in FIG. 2, a second transferring unit 115 is configured to transfer the image formed on the intermediate transferring belt 102 and is arranged below the intermediate transferring belt 102. The second transferring unit 115 includes two rollers 116, 117, and a second transferring belt 118, the second transferring belt 118 being engaged by the rollers 116, 117. Furthermore, the second transferring unit 115 is configured such that the second intermediate transferring belt 118 impinges with pressure against the driven roller 105 through the intermediate belt 102. In addition, the second intermediate unit 115 transfers the toner image on the intermediate transferring belt 102 onto a recording medium, such as paper, which is fed between the second transferring belt 118 and the intermediate transferring belt 102.

A fixation unit 119 is arranged downstream, in the sheet delivering direction, of the second transferring unit 115. In addition, the fixation unit 119 comprises a fixation belt 120 and a pressure roller 121 which impinges the fixation belt 120 with pressure. The second transferring unit 115 also fulfills the function of delivering a recording medium to the fixation unit 119.

A paper counterturn unit 122 is configured to counter-turn a recording medium so as to form an image on both faces of the medium and is arranged downstream of the second transferring unit 115.

Alternatively the second transferring unit 115 may be a transferring unit that includes a transferring roller and a contactless charger, etc.

Thus the image forming device 100 is a tandem indirect-transfer electrophotographic device. At the time of making a copy using this image forming apparatus, a user may set original material on the paper-rest 401 of the ADF 400. Alternatively, the user may open the ADF 400, set the original material on the contact glass 301 of the scanner device 300, and close the ADF 400 to hold the set original material.

When the user presses the start key on the operations unit, the image forming apparatus operates as follows.

For example, when the original material is set on the paper-rest 401 of the ADF 400, the scanner device 300 is driven so that a first running body 302 and a second running body 303 are moved back and forth in a sideways direction with respect to the illustration shown in FIG. 1 after the set original material is fed onto the contact glass 301. On the other hand, when the original material is set directly on the contact glass 301, the scanner device 300 is immediately driven so that the first and running bodies 302 and 303 are moved back and forth in a direction sideways with respect to the illustration shown in FIG. 1.

The first running body 302 has a light source for illuminating the original material. The light source lights up to emit light onto a surface of the original material on which an image is formed. Then, the light reflected from the original material is further reflected by the first running body 302 so as to be directed toward the second running body 303. In response, the light is reflected by the mirrors of the second running body 303 into a CCD (reading sensor) 305 through an imaging lens 304 and, as a result, the image of the original material is read.

Further, in response to the pressing of the start key, an intermediate transferring belt 102 begins to rotate.

Simultaneously, the photosensitive bodies 107Y, 107C, 107M, 107K are rotated so that single-color toners Y, M, C, and K adhere to the electrostatic latent images on the corresponding photosensitive drums 107Y, 107M, 107C, and 107K, thereby forming toner images of the respective single colors (single-color images).

With the rotation of the intermediate transferring belt 102, the single-color images are successively transferred onto the intermediate transferring belt 102, so that a composite color image of four-color super-position is formed on the intermediate transferring belt 102.

At the same time, in response to the pressing of the start key, a paper feed roller 201 of a selected paper cassette 203 of the paper feed device 200 starts rotating bringing out recording medium from the paper cassette 203, the recording medium being separated into a single recording medium by a separation roller 203. Furthermore, the recording medium is then delivered into a paper path 205.

From the paper path 205, the recording medium is delivered to a paper path 207 of the image forming device 100 by a paper delivery roller 206, and temporally stopped at a resister roller 208 by way of bumping into the resister roller 208. When manual paper feed is selected, the recording medium set on a manual paper feed tray 209 are fed by rotation of paper feed roller 210, and are separated into a single recording medium. The recording medium is then conveyed to a manual paper feed paper path 212 and temporally stopped at the resister roller 208.

The resister roller 208 starts rotating at the exact timing such that it synchronizes exactly with the delivery of the super-imposed image on the intermediate transferring belt 102. In addition, the recording medium, which was stopped, is then fed in-between the intermediate transferring belt 102 and the second transferring unit 115 resulting in the full-color image being transferred onto the fed recording medium from the intermediate transferring belt 102.

The recording medium including the transferred full-color image is then delivered to the fixation unit 119 by the second transferring unit 115, which functions as a delivering unit. The transferred full-color image is then fixed onto its recording medium with heating and pressing in the fixation unit 119.

Then the recording medium is guided to the output side by a branch claw 123 and output and stacked on a paper output tray 125 by a paper output roller 124.

If double-faced copy mode is selected, the recording medium with an image formed on its first face is conveyed to a sheet counterturn unit 123. The recording medium is then counter-turned at the sheet counterturn unit 123 and successively guided to the transferring position. An image is then formed on the second opposite face of the recording medium and output on the paper output tray 125 by the paper output roller 124.

When the drive motors drive rotation members, such as the four photosensitive bodies 107, the intermediate transferring belt 102, the second transferring belt 118, the fixation belt 120, or the resister roller 208, etc., the drive control for the drive motors should be controlled on the basis of equal velocity control. A detailed description of such a control is given next with regard to drive control device 3 that controls the drive motor which drives the rotation member.

Figure 3:
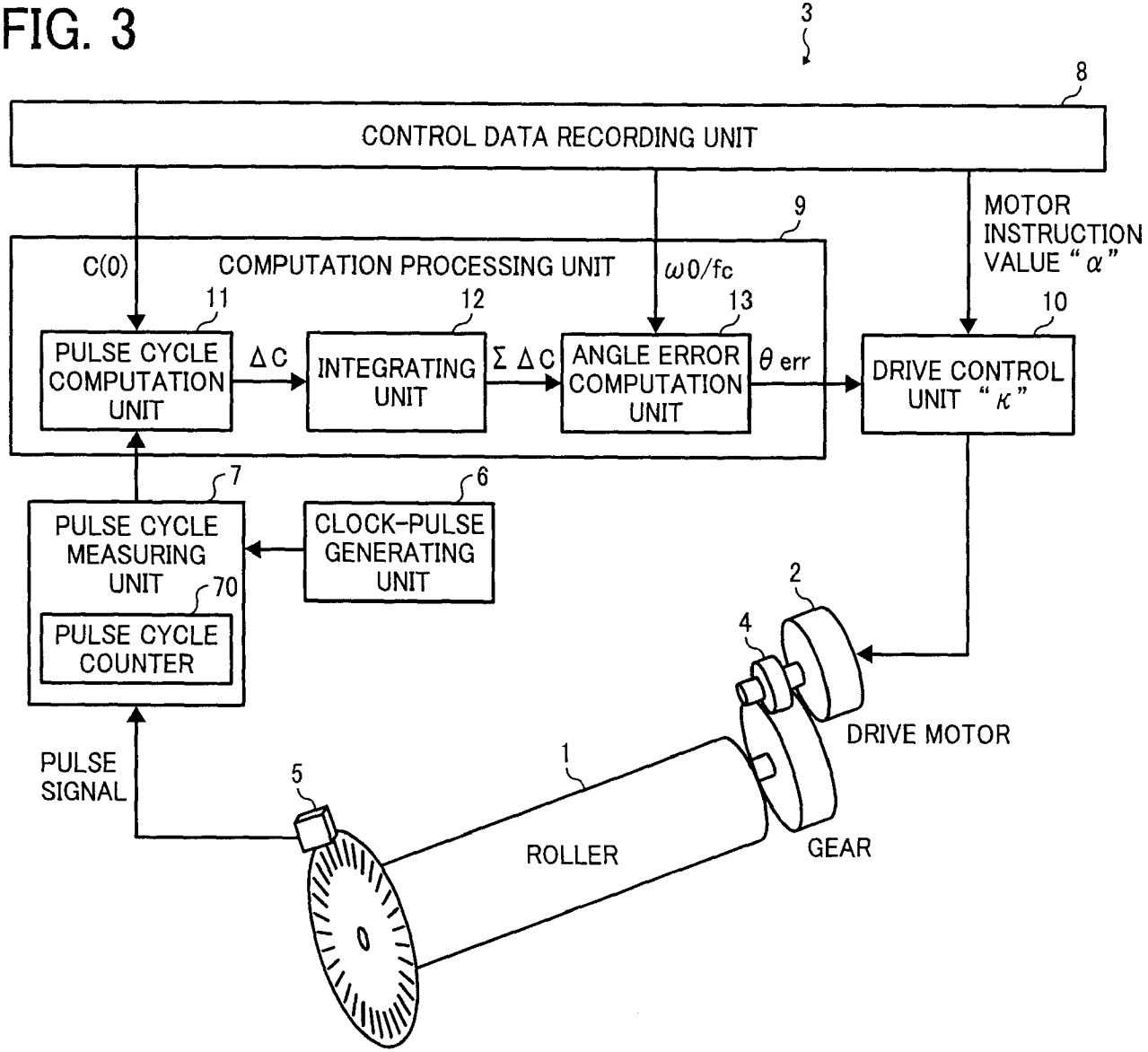
FIG. 3 is a block diagram showing a configuration of a drive control device that drives a rotation member.

FIG. 3 is a block diagram of the drive control device 3. A roller 1 is provided to control drive. As shown in FIG. 3, the drive control device 3 includes a drive motor 2 that drives the roller 1, a drive transmission unit 4 that connects the drive motor 2 and the roller 1, an encoder mounted on the roller 1, a clock-pulse generating unit 6, a pulse cycle measuring unit 7, a control data recording unit 8, a computation processing unit 9, and a drive control unit 10.

A stepping motor, a DC motor, a DC brushless motor or the like may be used for the drive motor 2. If the roller 1 is a photosensitive body 107, a decelerator may be used for the drive transmission unit 4. The photosensitive body 107 is used in the situation in which low rotation speed, about 60 rpm, and high drive torque is required. A direct drive may be acceptable although a gear is often used as the decelerator.

An optical encoder using a glass mask or etching slits in the metal can be used for encoder 5. Moreover, an encoder board that spreads photo emulsion material on PET film thus exposing and developing it may be usefully for lowering costs. The angular resolution capability d θ can be determined by the number of rotations and the frequency to be controlled.

Figure 4:
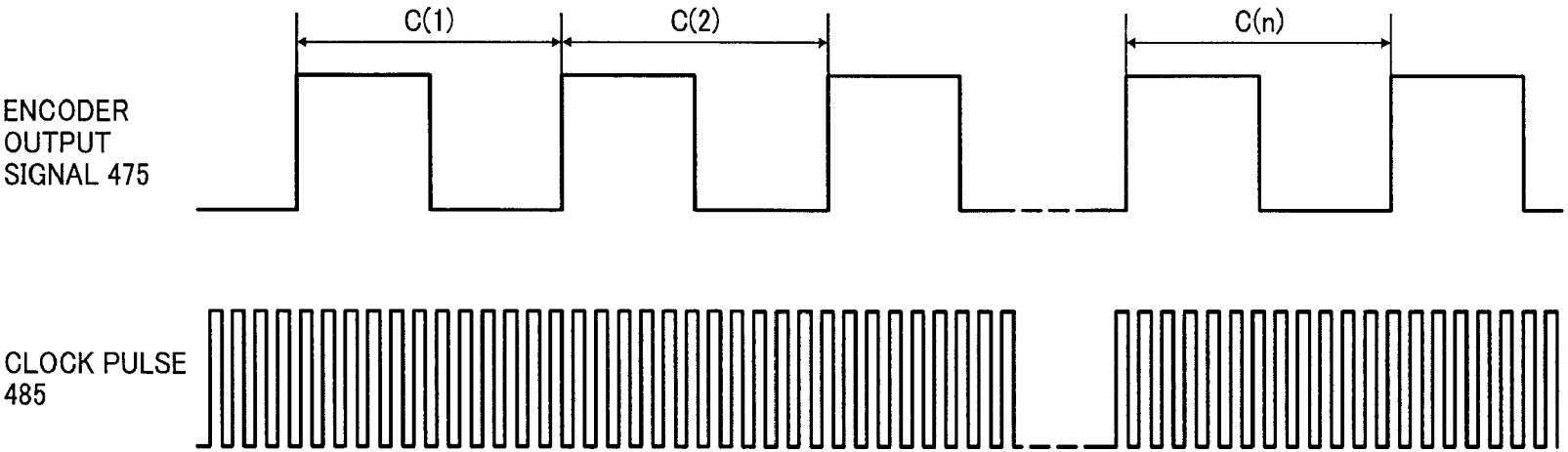
FIG. 4 is a waveform chat showing an output signal from an encoder and an output signal from a clock pulse generating unit.

As is illustrated in FIGS. 3 and 4, the encoder 5 outputs a pulse signal 475 to the pulse cycle measuring unit 7 for each predetermined angle of rotation of the roller 1. A pulse cycle counter 70 counts rising edge cycles or falling edge cycles of the pulse signal which is output from the encoder 5 and sequentially outputs the counted value, [C(1), C(2), to C(n)], to the computation processing unit 9 based on a clock pulse sent from the clock-pulse generating unit 6.

The computation processing unit 9 includes a cycle error computation unit 11, an integrating unit 12, and an angular error computation unit 13. The computation processing unit 9 computes an angular error $\theta_{err}$ from the desired angle by using the counted value [C(1), C(2) to C(n)] output by the pulse cycle measuring unit 7.

The processing of the computation processing unit 9 will now be explained. Initially, the overarching principle of processing of the computation processing unit 9 will be explained.

The counted values of the edge cycle, such as C(1), C(2) to C(n), which are output from the pulse cycle counter 70 of the pulse cycle measuring unit 7 are edge interval times of the pulse signals which are output from the encoder 5. As a result, the angular velocity error $\omega_{err}$ can be calculated using equation (1) having the parameters such as a frequency of the clock pulse $f_c$ output from the clock-pulse generating unit 6, the counted value of the edge cycle C(n) [n=1−n], an angular resolution capability of the encoder 5 dθ, and a desired angular velocity of the roller 1 $\omega_0$.

$$\omega err=[fc/C(n)]*d\theta-\omega 0 \quad (1)$$

The angular velocity $\theta_{err}$ can be calculated by integrating the angular velocity error $\omega_{err}$. Specifically, the angular error $\theta_{err}$ can be obtained using equation (4). Further, because of the relationship $\theta=\omega_t$, the angular error $\theta_{err}$ can be obtained using equation (2). In addition, the relationship between t(n), C(n), and $f_c$ as shown in equation (3) derives the equation (2) and equation (4).

$$\theta_{err}(n)=\omega_0(t(0)-t(n)) \quad (2)$$

$$t(n)=C(n)/f_c \quad (3)$$

$$\theta_{err}=(\omega_0/f_c)\cdot\Sigma\{C(n)-c(0)\} \quad (4)$$

The computation processing unit 9 computes the angular error $\theta_{err}$ based on the equation (4) and outputs the angular error $\theta_{err}$ to the drive control unit 10.

Since the desired angular velocity $\omega_0$ and the frequency of clock pulse $f_c$ are constant values, a desired count value C(0) can be determined based on the desired angular velocity $\omega_0$ and the frequency of clock pulse $f_c$. Therefore, the value of $\omega_0/f_c$ and the desired count value C(0) of each motor instruction value are preliminarily stored in the control data recording unit 8.

Figure 5:
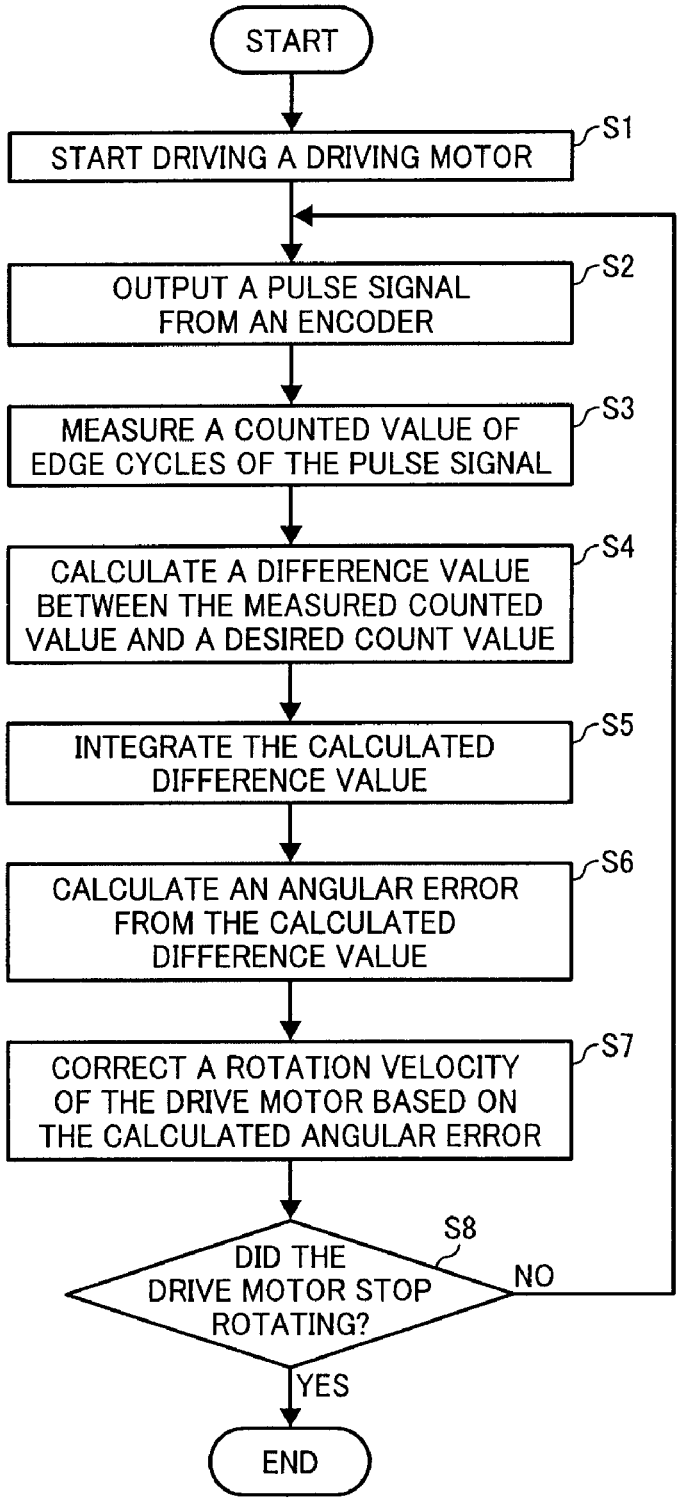
FIG. 5 is a flowchart showing a process of controlling the velocity of the rotation member by the drive control device.

FIG. 5 shows a flowchart of the process of controlling a rotation velocity of the drive motor 2 by calculating the angular error when the roller 1 in the drive control device 3 is rotating. Referring to FIG. 5, the process of controlling the rotation velocity of the drive motor 2 is explained.

When the drive control unit 10 receives the drive instruction, the drive control unit 10 reads the motor instruction value from the control data recording unit 8 and drives the drive motor 2 to rotate the roller 1 (Step S1). The encoder 5 then outputs a pulse signal to the pulse cycle measuring unit 7 at each predetermined angle of rotation of the roller 1 (Step S2). In response, the pulse cycle counter 70 of the pulse cycle measuring unit 7 sequentially counts the edge cycle of the pulse signal, which is output by the encoder 5, using the clock pulse, which is output from the clock-pulse generating unit 6, and outputs the counted value [C(1), C(2) to C(n)] to the computation processing unit 9 (Step S3). The cycle error computation unit 11 of the computation processing unit 9 calculates the difference value ΔC [where ΔC=C(n)−C(0)] from the counted value C(n), which is output by the pulse cycle measuring unit 7, and the desired count value C(0), which is stored in the control data recording unit 8, and outputs the difference value ΔC to the integrating unit 12 (Step S4).

The integrating unit 12 integrates the difference value ΔC so as to calculate an integrated value ΣΔC whenever the integrating unit 12 receives the difference value ΔC, and outputs the integrated difference value ΣΔC to the angular error computation unit 13 (Step S5). The angular error computation unit 13 calculates the angular error $\theta_{err}$ by multiplying the integrated difference value ΣΔC which is output by the integrating unit 12 and the ratio of the desired angular velocity $\omega_0$ to the frequency of the clock pulse $f_c$, where the desired angular velocity and the frequency of the clock pulse are stored in the control data recording unit 8, and outputs the angular error $\theta_{err}$ to the drive control unit 10 (Step S6).

The drive control unit 10 then controls the drive motor 2 with a corrected motor instruction value which is obtained by multiplying the angular error $\theta_{err}$, a predetermined gain K and a motor instruction value conversion coefficient "α" (Step S7). The process performed from Step S2 to Step S7 is repeated while the drive motor 2 drives the rotation on the roller 1 (Step S8).

Thus, the computation processing unit 9 calculates the angular error $\theta_{err}$ of the roller 1 easily, since the angular error is calculated from the counted value of edge cycle of pulse signal C(n), the desired count value C(0) and the ratio of the desired angular velocity $\omega_0$ to the frequency of clock pulse $f_c$.

The drive control of the electrophotography image forming system is generally the basis for equal velocity control, but it is also desirable to be the basis for tracking control using a desired ramp function so as to prevent position displacement and color drift of the image. Using an encoder pulse count in order to determine rotation position for position control typically requires very high resolution for the encoder. However, there are circumstances in which a high resolution encoder can not be mounted on a mass produced machine.

Thus, since the encoder 5 is the source of the counted value of the edge cycle of pulse signal C(n) the encoder 5 must have a resolution sufficient to enable the frequency of control cycle to be obtained, thus enabling the computation processing unit 9 to obtain the angular error of rotating roller 1.

This embodiment may also be applied to the linear velocity control of a belt, such as the intermediate transferring belt 102 etc.

Figure 6:
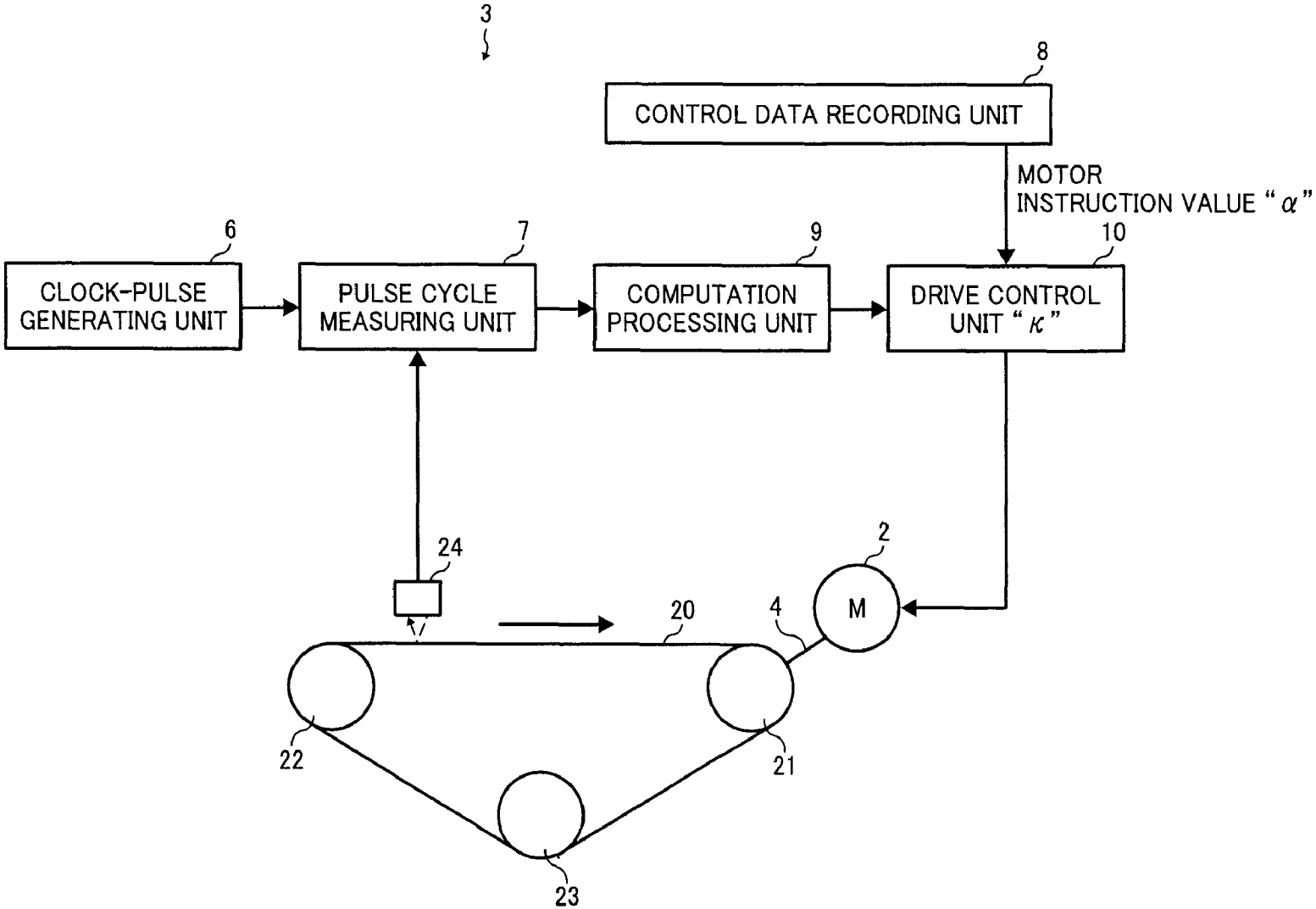
FIG. 6 is a block diagram showing an alternative embodiment of the configuration of a drive control that drives a rotation member.

FIG. 6 shows a block diagram of a drive control device 3 which includes an intermediate transferring belt 102.

This drive control device 3 includes an endless belt 20, such as intermediate transferring belt 102 or the like, a drive roller 21, two driven rollers 22, 23, a drive motor 2 and a drive transmission unit 4. The endless belt 20 is provided to engage the drive roller 21 and the driven rollers 22, 23, and is driven to rotate by the drive roller 21, where the drive force of the drive roller 21 is the rotation drive power of the drive motor 2 which is transmitted to the driven roller 21 through the drive transmission unit 4. Further, the optical markers are arranged at regular intervals on the endless belt 20. A belt mark sensor is included in the drive control device 3, where the belt mark sensor includes an optical sensor 24 that reads the optical markers and outputs a pulse signal in response to the rotation of the endless belt 20.

The pulse signal output from the optical sensor 24 is output, similarly to the encoder 5 output, in response to the detection of optical markers arranged on the endless belt 20 at regular intervals. Further, the pulse signal output from optical sensor 24 is input to the pulse cycle measuring unit 7, which calculates a counted value corresponding to a pulse cycle and outputs the counted value to the computation processing unit 9. The computation processing unit 9 then calculates a position error of the rotating endless belt 20 based on the counted value.

The counted value obtained by the pulse cycle measuring unit 7 indicates an amount of time that it takes for the endless belt 20 to move the interval between the optical markers dx. As a result, the angle θ is changed to a distance P, and an angular velocity is changed to a velocity V, in equations (1) to (4). Particularly, when a position error with respect to a desired position of the endless belt 20 is $P_{err}$, a desired velocity is $V_0$, a cycle of clock pulses generated by the clock pulse generating unit 6 is $f_c$, a desired count value is $C_0$, and a counted value of the pulse cycle measuring unit 7 is C(n), where n is greater than 0, then the equation (4) is represented as an equation (5).

$$P_{err}=(V_0/f_c)*\Sigma[C(n)-C(0)] \quad (5)$$

The rotation of the endless belt 20 at constant velocity can be achieved by controlling the drive of the drive motor 2 using the position error $P_{err}$ calculated by equation (5).

Moreover, if a pulse cycle timer is used as the pulse cycle measuring unit 7 in place of the pulse cycle counter 70, the pulse cycle of the pulse signal from the optical sensor 24 can be measured as an edge interval time without any need for the input of a clock pulse to the pulse cycle measuring unit 7.

When the pulse cycle timer is used for the pulse cycle measuring unit 7, the parameters are as follows: a criterion value of the edge interval time is t(0), an edge interval time of the pulse signal from the optical sensor 24 output from the pulse cycle measuring unit 7 is t(n), where n is greater than 0. In addition, the equation is then defined as equation (6) as shown below.

$$P_{err}=V_0*\Sigma[t(n)-t(0)] \quad (6)$$

Since the position error $P_{err}$ can be calculated by sending the edge interval time t(n) of the pulse signal received from the optical sensor 24 to the computation processing unit 9, calculating the position error $P_{err}$ can be more easily accomplished.

In the aforementioned explanation, there is described a method for the driving control of a drive motor 2 which rotates an endless belt 20 based on a position error $P_{err}$ which is calculated by a computation processing unit 9.

In the following explanation there is provided a method which takes into account the interval error of the optical markers arranged on the endless belt 20, the stretch or shrink of the endless belt 20, and any discontinuations of the optical markers arranged on the endless belt 20.

Figure 7:
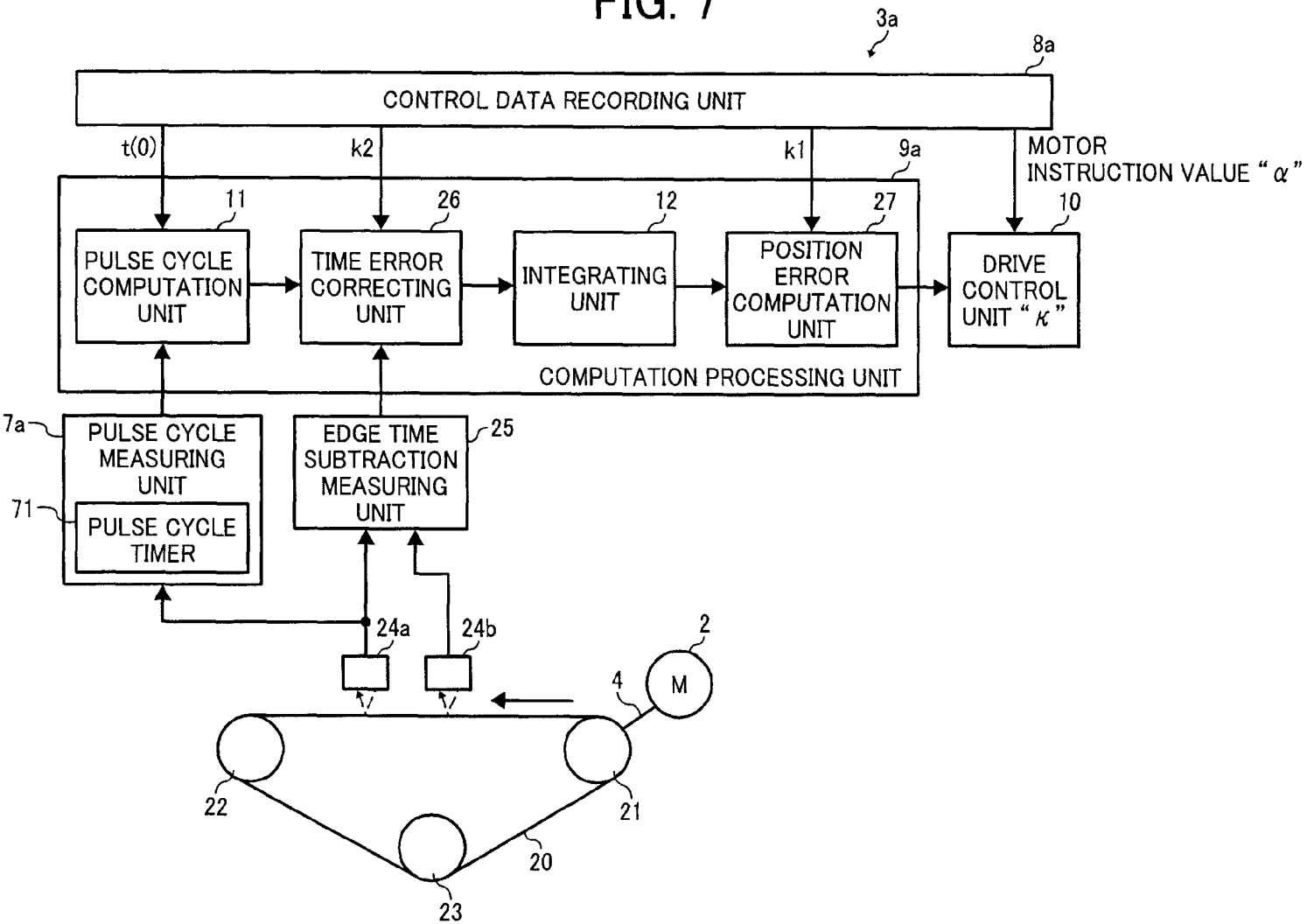
FIG. 7 is a block diagram showing another alternative embodiment of the configuration of the drive control that drives the rotation member.

FIG. 7 shows a block diagram illustrating this alternative drive control device 3*a*. The drive control device 3*a* includes a plurality of optical sensors 24*a*, 24*b* which detect the optical markers arranged on the endless belt 20. Also included is a pulse cycle measuring unit 7*a* which receives the pulse signal from the optical sensor 24*a*, and includes a pulse cycle timer 71 for measuring an edge interval time $t_a(n)$. Further, an edge time subtraction measuring unit 25, for instance a pulse cycle timer, measures an edge time subtraction between pulse signals that are output from the two optical sensors 24*a*, 24*b*. The edge time subtraction measuring unit 25 then outputs the edge time subtraction to a computation processing unit 9*a* which calculates position error $P_{err}$ correcting a pitch change of the optical markers.

The computation processing unit 9*a* comprises the cycle error computation unit 11, a time error correcting unit 26, the integrating unit 12, and a position error computing unit 27.

Figure 8:
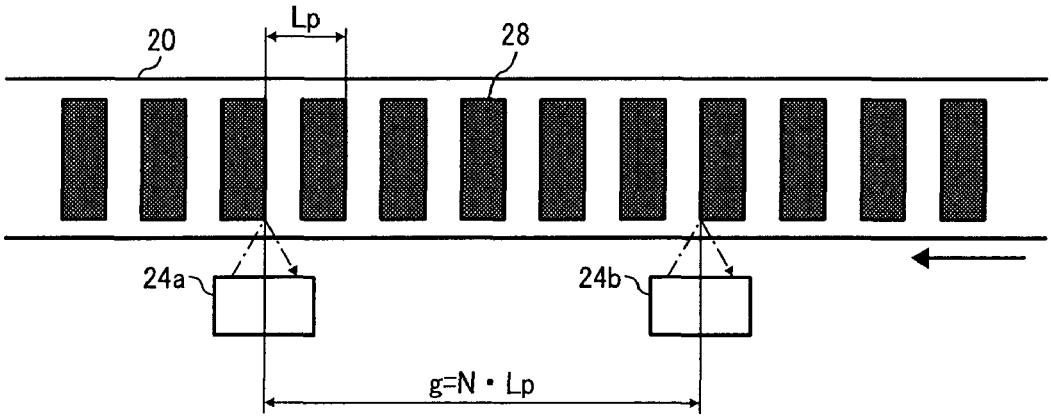
FIG. 8 is a diagram showing an arrangement of optical sensors and optical markers arranged on the rotation member.
Figure 9:
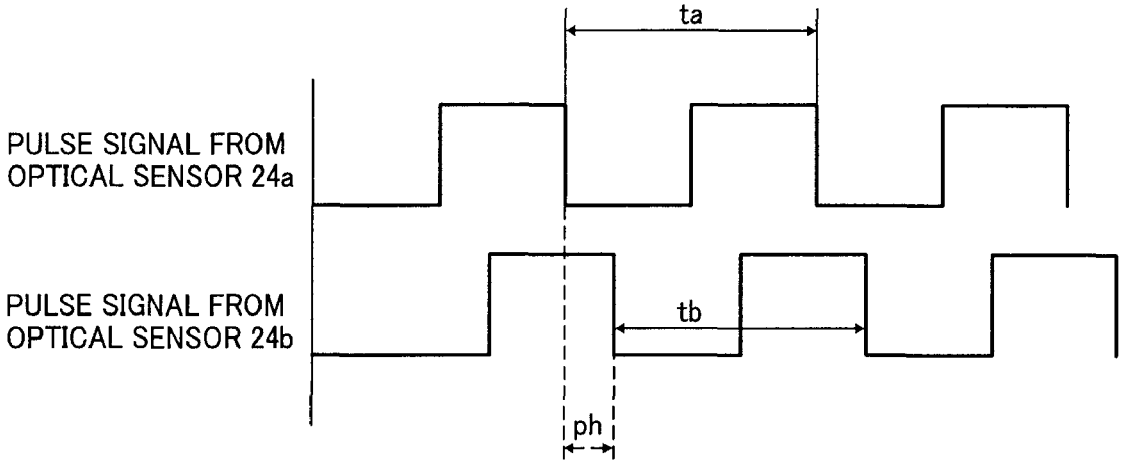
FIG. 9 is a waveform chart showing output signals from the optical sensors shown in FIG. 8 according to an embodiment of the present invention.

The process of calculating the position error $P_{err}$ which corrects the pitch change is now explained. As shown in FIG. 8, the endless belt 20 includes optical marker(s) 28 that are arranged on the endless belt 20 at regular intervals Lp. The optical sensors 24*a* and 24*b* are placed along with the endless belt 20 at regular intervals g. For simplification of the explanation, it is assumed the interval g between the two optical sensors 24*a* and 24*b* is determined by g=N*Lp (where N is a natural number). If there is no error in the interval between the optical markers 28 Lp, then the edges of the pulse signals output from the two optical sensors 24*a* and 24*b* should be exactly consistent. However, if this is not the case, then, as shown in a waveform chart of FIG. 9, time subtraction ph is needed between the edges of the pulse signals output from the two optical sensors 24*a* and 24*b*.

This time subtraction ph indicates that stretching has occurred in the distance g between the two optical sensors 24*a* and 24*b*, the velocity of the endless belt 20 being V. The stretch can be determined using (V*ph)/(N*Lp), since the distance g between the two optical sensors 24*a* and 24*b* is described as N*Lp.

If the endless belt 20 is stretched, the edge time subtraction ta(n) measured by the pulse cycle timer 70 of the pulse cycle measuring unit 7*a* is a time between intervals, where the interval of the optical markers is determined using Lp[1+(V*ph)/(N*Lp)]. As a result, correct velocity can be obtained by calculating Lp[1+(V*ph)/(N*Lp)]/ta(n).

Moreover, position error $P_{err}$ previously mentioned with regard to equation (6) can be determined using equation (7) by assuming that the velocity V of the endless belt 20 is nearly equal to the desired velocity $V_0$.

$$P_{err}=V_0*\Sigma[t(n)-t(0)+ph(n)/N] \quad (7)$$

In addition, if an interval between the two optical sensors 24*a* and 24*b* is an integral multiple of the regular interval LP of the optical markers, then the position error $P_{err}$ can be obtained using equation (7). However, if this is not the case, the position error $P_{err}$ may be obtained using equation (8).

$$P_{err}=V_0*\Sigma[t(n)-t(0)+ph(n)/(g/Lp)] \quad (8)$$

In addition, if $V_0$ is replaced with k1 and g/Lp with k2 as they are constant values, the equation (8), $P_{err}$ can be determined using equation (9).

$$P_{err}=k1*\Sigma[t(n)-t(0)+ph(n)/k2] \quad (9)$$

Thus, the position error $P_{err}$ can be obtained using a simple computation operation, such as equations (6), (7), (8), and by measuring the time subtraction of edges ph (n) using the edge time subtraction measuring unit 25.

Further, when the position error $P_{err}$ is calculated based on the equation (9), the operation in the computation processing unit 9*a* can be simplified by recording the criterion edge interval time t(0), a desired velocity V0 of the endless belt 20 as the constant value k1, and g/Lp as the constant value k2 in the control data recording unit 8*a*.

Figure 10:
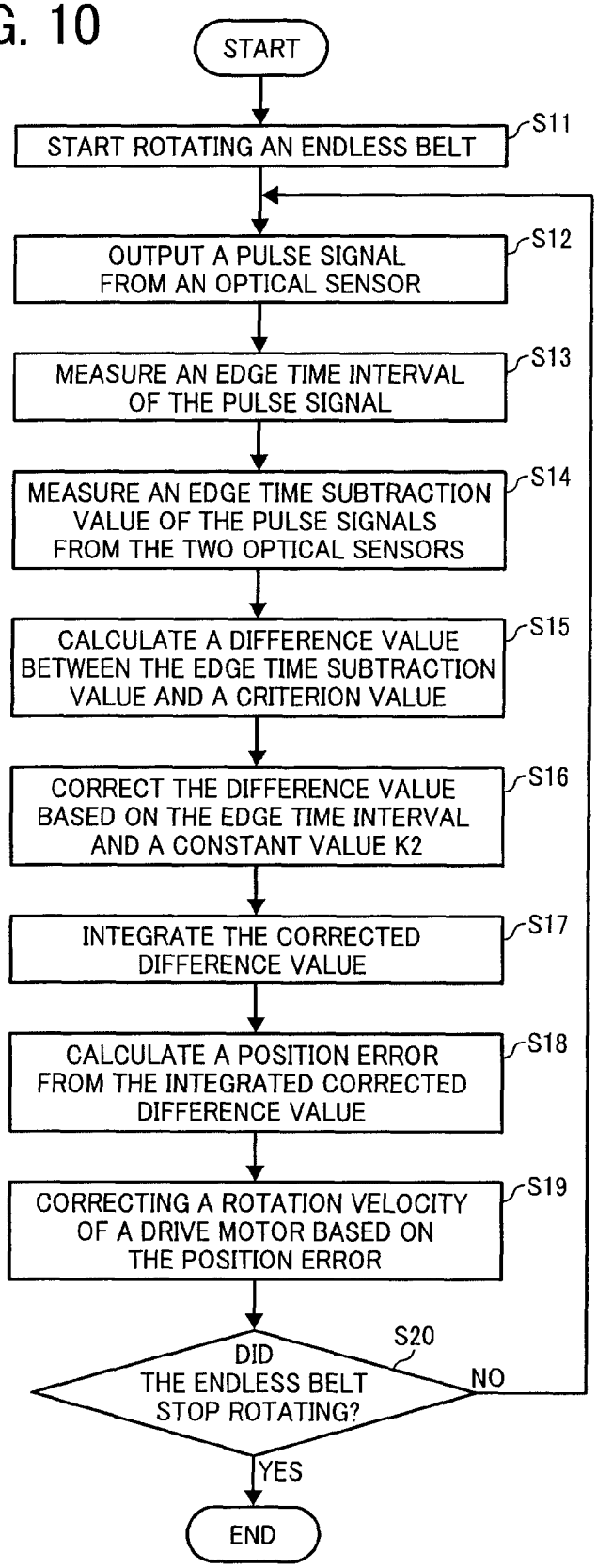
FIG. 10 is a flowchart showing a process of controlling the velocity of the rotation member by the drive control device shown in FIG. 7 according to an embodiment of the present invention.

FIG. 10 shows a flow chart illustrating the process of controlling a rotation velocity of the drive motor 2 in the drive control device 3*a*. When the drive control unit 10 receives the drive instruction, the drive control unit 10 then reads the motor instruction value from the control data recording unit 8*a* and drives the drive motor 2 (Step S11).

When the endless belt 20 starts rotating as a result of the driving of the drive motor 2, the optical sensor 24*a* outputs a pulse signal to the pulse cycle timer 71 of the pulse cycle measuring unit 7 and to the edge time subtraction measuring unit 25. In addition, the optical sensor 24*b* also outputs a pulse signal to the edge time subtraction measuring unit 25 (Step S12). Each of the two optical sensors 24*a* and 24*b* outputs a pulse signal whenever they detect the optical marker 28 arranged on the endless belt 20.

The pulse cycle timer 71 then outputs an edge interval time ta(n), where n is greater than 0, of the pulse signal output from the optical sensor 24*a* to the pulse cycle error computation unit 11 of the computation processing unit 9*a* (Step S13). Concurrently, the edge time subtraction measuring unit 25 measures the edge subtraction ph between the pulse signals sent from the two optical sensors 24*a* and 24*b* and outputs the edge subtraction ph to the time error correcting unit 26 (Step S14).

The pulse cycle error computation unit 11 calculates a difference of the edge interval times Δt(n) which is a difference between the edge interval time ta(n) output from the pulse cycle timer 71 and the criterion time of edge interval time t(0), Δt(n)=t(n)−t(0), and outputs the difference of the edge interval time Δt(n) to the time error correcting unit 26 (Step S15).

When the edge interval time Δt(n) is input, the time error correcting unit 26 corrects the edge interval time Δt(n) based on edge time subtraction between the two pulse signals and the constant value k2 stored in the control data recording unit 8*a*. The time error correcting unit 26 then outputs the corrected edge interval time to the integrating unit 12 (Step S16).

When the corrected edge interval time is input, the integrating unit 12 integrates the corrected edge interval time so as to calculate an integrated value. Further, the integrating unit 12 outputs the calculated integrated value to the position error computation unit 27 (Step S17).

The position error computation unit 27 then multiplies the constant value k1 stored in the control data recording unit 8*a* with the integrated value sent from the integrating unit 12 in order to obtain the position error $P_{err}$. The position error computation unit 27 then outputs the obtained position error $P_{err}$ to the drive control unit 10 (Step S18).

The drive control unit 10 multiplies together the predetermined gain K, the motor instruction value conversion coefficient "α" for the drive motor 2 and the position error $P_{err}$ in order to obtain the corrected motor instruction value which is used by the drive control unit 10 to control the drive motor 2 (Step S19). The operation executed between Steps S12 and S19 may be repeated while the drive motor 2 drives the rotation of the endless belt 20 (Step S20).

Thus, an alternative embodiment of the drive control device 3*a* is able to control the endless belt 20 with high accuracy and small computation requirements, since the drive control device 3*a* measures the edge time subtraction ph between the pulse signals detected by the optical sensors 24*a* and 24*b* arranged at regular intervals while at the same time correcting any pitch error of the optical markers.

When the position error $P_{err}$ is calculated by measuring the edge time subtraction ph of the pulse signals and the edge interval time ta(n) of the optical markers 28 arranged on the endless belt 20, the velocity of the endless belt 20 can be calculated taking into account any error which is caused by the existence of discontinuous parts of the optical markers 28 arranged on the endless belt 20.

Figure 11:
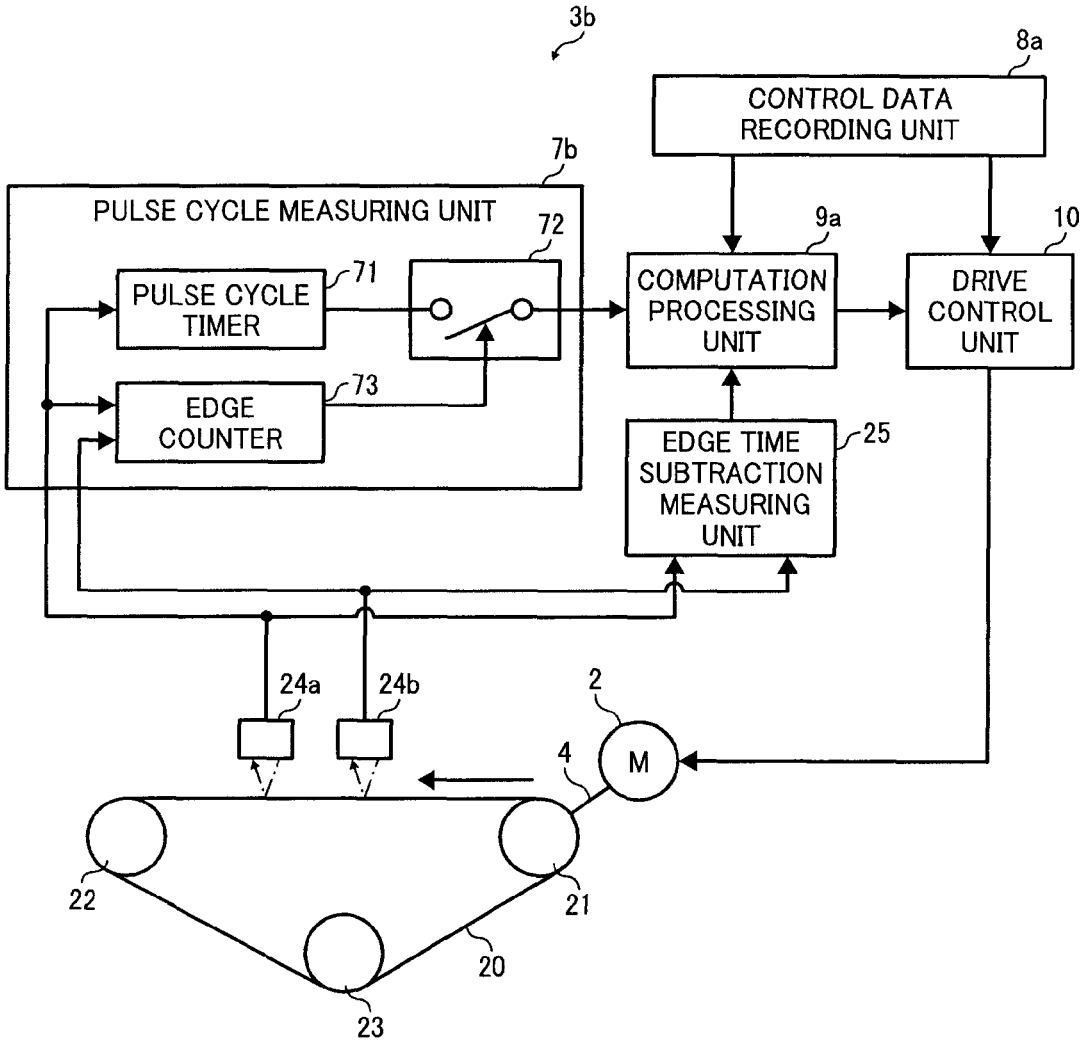
FIG. 11 is a block diagram showing another alternative embodiment of the configuration of the drive control device shown in FIG. 7 according to an embodiment of the present invention.

The block diagram shown in FIG. 11 shows a drive control device 3*b* comprising a pulse cycle measuring unit 7*b* which is an alternative embodiment of the pulse cycle measuring unit 7*a*. The pulse cycle measuring unit 7*b* includes a pulse cycle timer 71, a selector 72 which selectively outputs the pulse cycle timer 71 output, and an edge counter 73 that switches the selector 72 based on the pulse signals output from the optical sensors 24*a* and 24*b*. The edge counter 73 increments a counter whenever a falling edge is input into a first input terminal and decrements the counter whenever a falling edge is input to a second input terminal.

Figure 12:
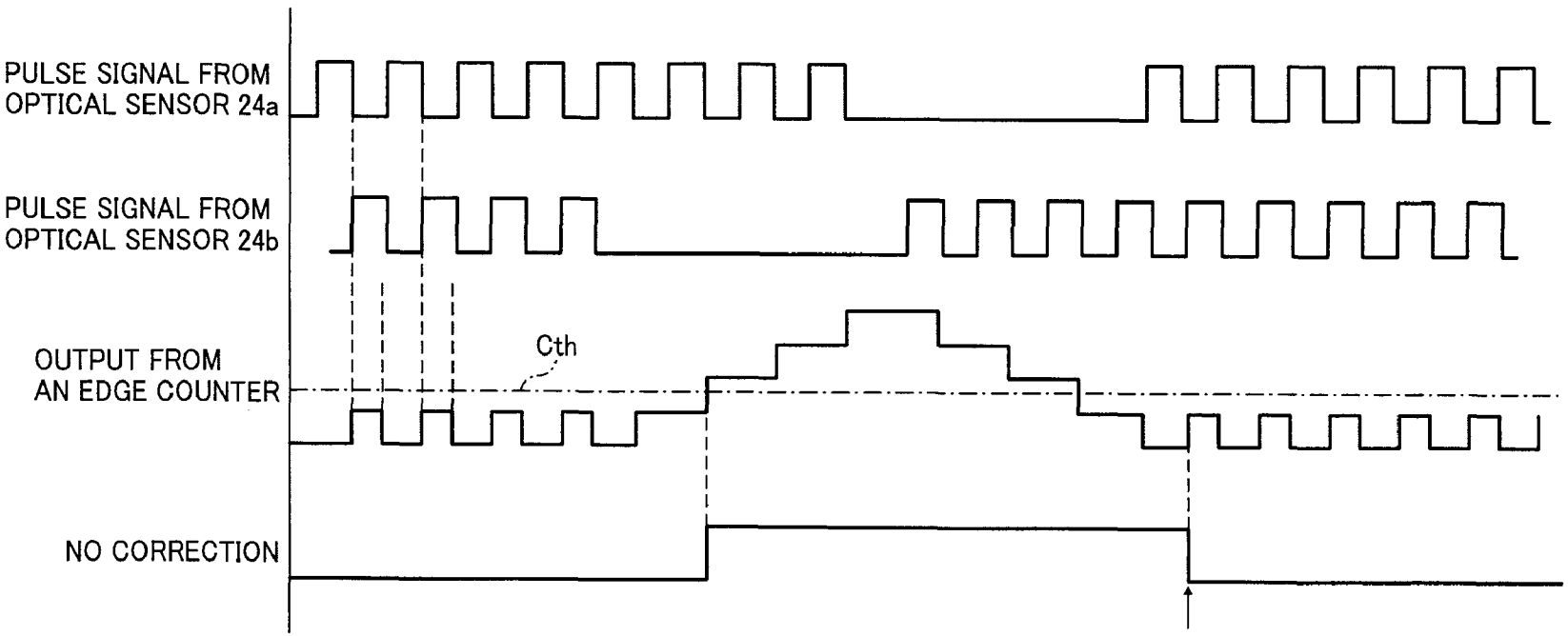
FIG. 12 is a waveform chart showing output signals from the optical sensors, an output signal from the edge counter, and an exemplified signal indicating whether correction processing has occurred according to the embodiment of the present invention shown in FIG. 11.

The edge counter 73 increments a counter when the edge of the pulse signal output from the optical sensor 24*a* is a falling edge, and decrements the counter when edge of the pulse signal output from the optical sensor 24*b* is a falling edge, as shown in the waveform chart of FIG. 12.

In the edge counter 73, the counted value increases while the pulse signal from the optical sensor 24*b* is null, and the counted value decreases while the pulse signal from the optical sensor 24*a* is null.

A threshold Cth is set for the counted value of the edge counter 73 so as to detect if the optical markers 28 arranged on the endless belt 20 are discontinuous, by determining if the counted value of the edge counter 73 exceeds the threshold Cth.

When discontinuous of the optical markers 28 are detected, the edge counter 73 outputs a signal to the selector 72 that indicates that the optical markers 28 are discontinuous. The selector 72 then interrupts the output of the pulse cycle ta(n), output from the pulse cycle timer 71, to the computation processing unit 9*a* so as to interrupt any position error $P_{err}$ correction by the computation processing unit 9*a*.

Thus, preventing a change in the velocity of the endless belt 20 can be achieved, even when discontinuation of the optical markers exists on the endless belt 20.

Moreover, the edge counter 73 also outputs a signal which indicates that the optical markers 28 are continuous to the selector 72. This signal is output when the counted value of the edge counter 73 first increases (as is illustrated with an arrow in FIG. 12) after the output of a signal which indicates that the optical markers 28 are discontinuous. The selector 72 then starts to output the pulse cycle ta(n) to the computation processing unit 9*a*.

Figure 13:
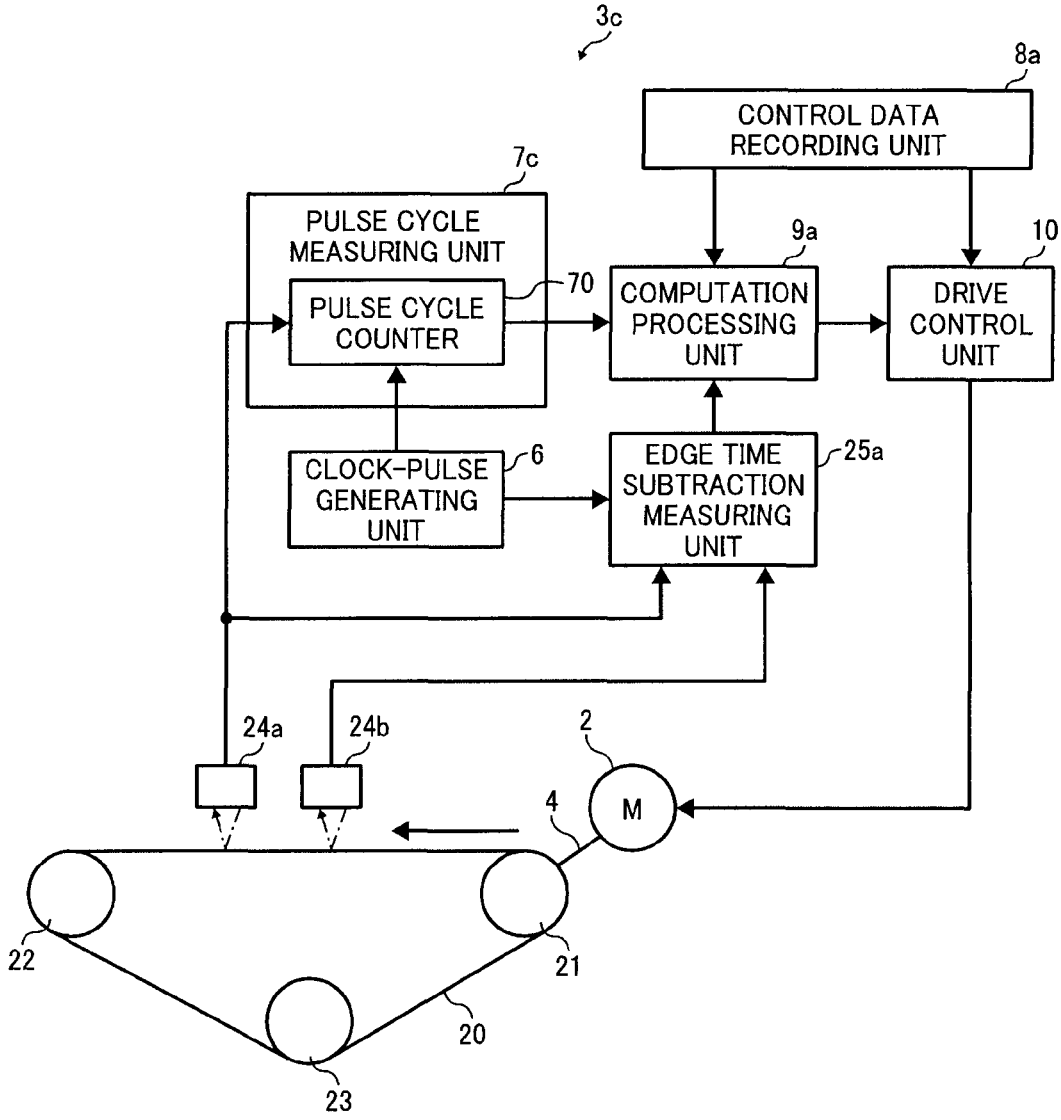
FIG. 13 is a block diagram showing another alternative embodiment of the configuration of the drive control device shown in FIG. 11 according to an embodiment of the present invention.

In the aforementioned explanation, the embodiments in which the pulse cycle measuring unit 7*a* or 7*b* includes the pulse cycle timer 71 have been described. In an alternative embodiment, the pulse cycle measuring unit 7*c* is modified to include a pulse cycle counter 70 as shown in FIG. 13. Specifically, FIG. 13 shows a block diagram for the alternative drive control device 3*c*.

The alternative drive control device 3*c* includes a pulse cycle counter 70 which counts the counted value of the pulse signal of edge cycle C(n) output from the optical sensor 24*a* using the clock pulse from the clock pulse generating unit 6. In addition, an edge time subtraction measuring unit 25*a* counts a counted value of the edge time subtraction Cph(n) between the pulse signals output from the optical sensors 24*a* and 24*b* using the clock pulse output from the clock pulse generating unit 6.

The position error $P_{err}$, in which the pitch error of the optical markers 28 is considered and corrected, can then be calculated using the counted value of the pulse signal of edge cycle C(n) and the counted value of the edge time subtraction Cph(n).

In this embodiment, equation (5) can be modified as equation (10).

$$P_{err}=(V_0/f_c)*\Sigma[C(n)-C(0)+Cph(n)/(g/Lp)] \quad (10)$$

The output of the pulse cycle timer 71 is in a time format, while the output of the pulse cycle counter 70 is a counted value counted by the clock pulse $f_c$. The output of the pulse cycle counter 70 can be converted to time by dividing the clock pulse $f_c$.

Figure 14:
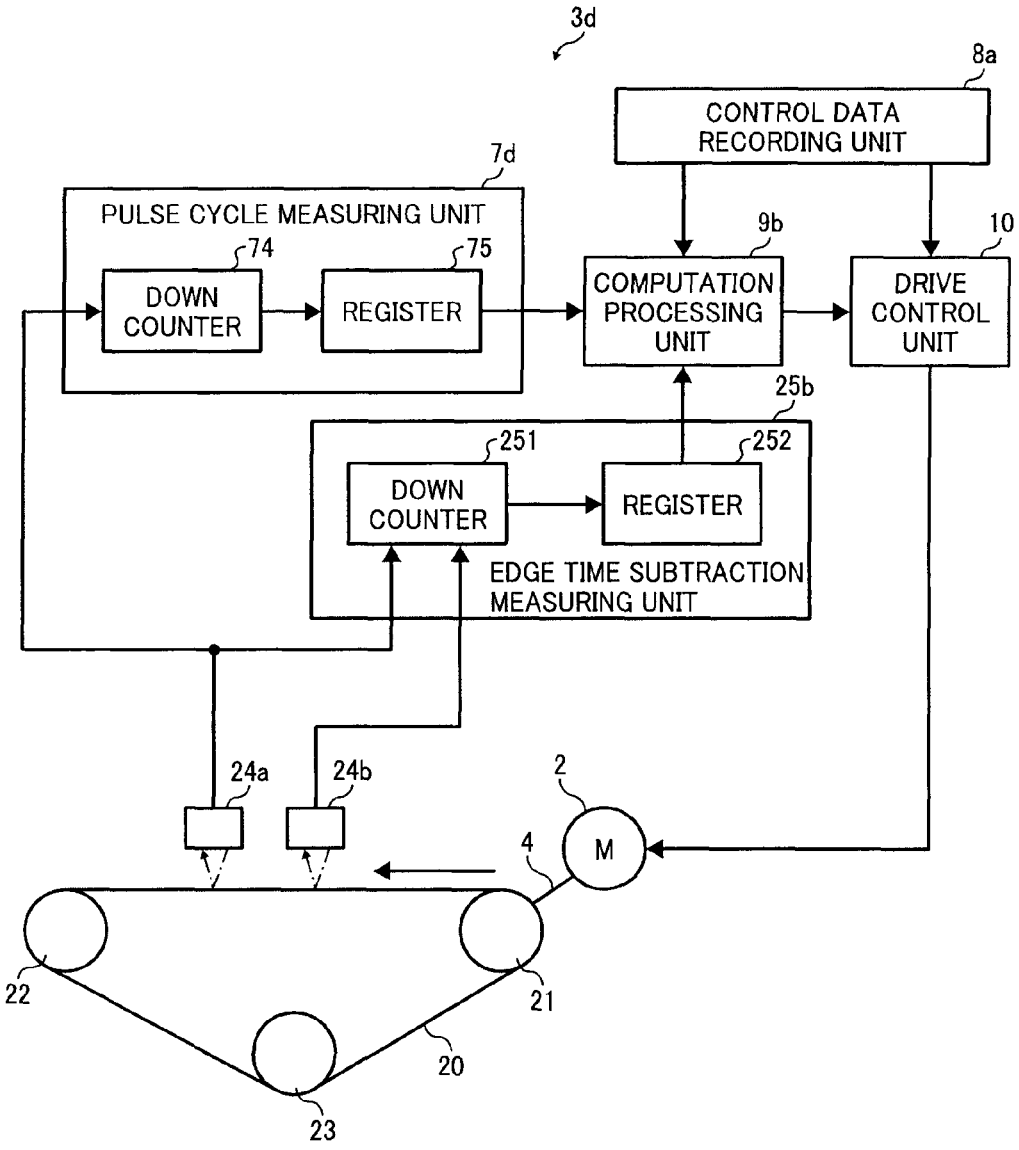
FIG. 14 is a block diagram showing another alternative embodiment of the configuration of the drive control device shown in FIG. 13 according to an embodiment of the present invention.

In the aforementioned explanation, the embodiment in which the pulse cycle measuring unit 7*c* includes a pulse cycle counter 70 is described. In alternative embodiment shown in FIG. 14, a block diagram for the alternative drive control device 3*d* is illustrated. In this embodiment, the pulse cycle measuring unit 7*c* is modified to be pulse cycle measuring unit 7*d* which includes a down counter 74 and a register 75. Further the edge time subtraction unit 25 is modified to be edge time subtraction unit 25*b* which includes a down counter 251 and a register 252. Using a down counter such as down counter 74 or 251 can reduce the amount of computation needed in the process.

Figure 15:
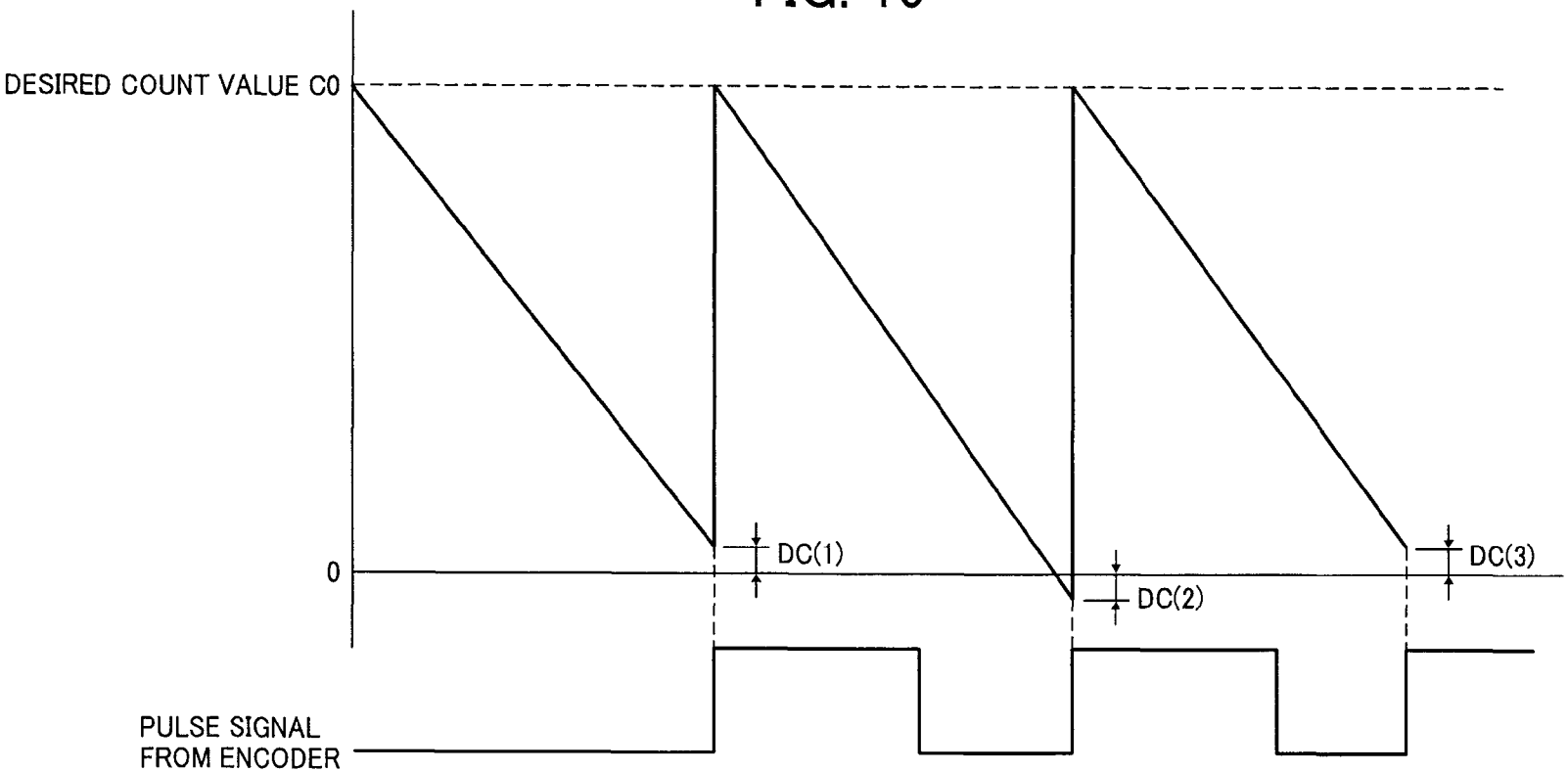
FIG. 15 is a diagram showing an operation of the down counter shown in FIG. 14 according to an embodiment of the present invention.

As is noted above, the pulse cycle measuring unit 7*d* includes the down counter 74 and the register 75. The down counter 74 sets a desired count corresponding to the desired velocity, and resets a counted value which is output to the register 75 after inputting the edge pulse signal from the encoder 5 or the optical sensor 24*a*. As shown in FIG. 15, the down counter 74 outputs a counted data DC(n), where n is greater than 0, to the register 75 and resets the counted value to a desired counted value C(0) at every rising edge of the pulse signal received from the encoder 5 or the optical sensor 24*a*.

Moreover, the counted value DC(n) can be obtained by a relationship between the desired counted value C(0) and the counted value C(n) as DC(n)=C(n)□C(0). So the difference value ΔC between the counted value C(n) and the desired counted value C(0) can be obtained by inversing the counted value DC(n). Therefore, a configuration and processing of the computation processing unit 9 or 9*a* can be simplified by the configuration of computation processing unit 9*b*. For example, if an up counter, preset as having a minus count value for the desired counted value C(0), is used, then the difference value can be obtained without inversing.

Moreover, the edge time subtraction measuring unit 25 or 25*a* can be modified to be an edge time subtraction measuring unit 25*b* which includes the down counter 251 and the register 252. The down counter 251 counts an edge interval of the pulse signals received from the optical sensor 24*a* and 24*b*. The down counter 251 is configured to initialize the counter when the edge of the a first pulse signal from the optical sensor 24*a* is received and output the counted value to the register 252 when the edge of a second pulse signal from the optical sensor 24*b* is received.

Figure 16:
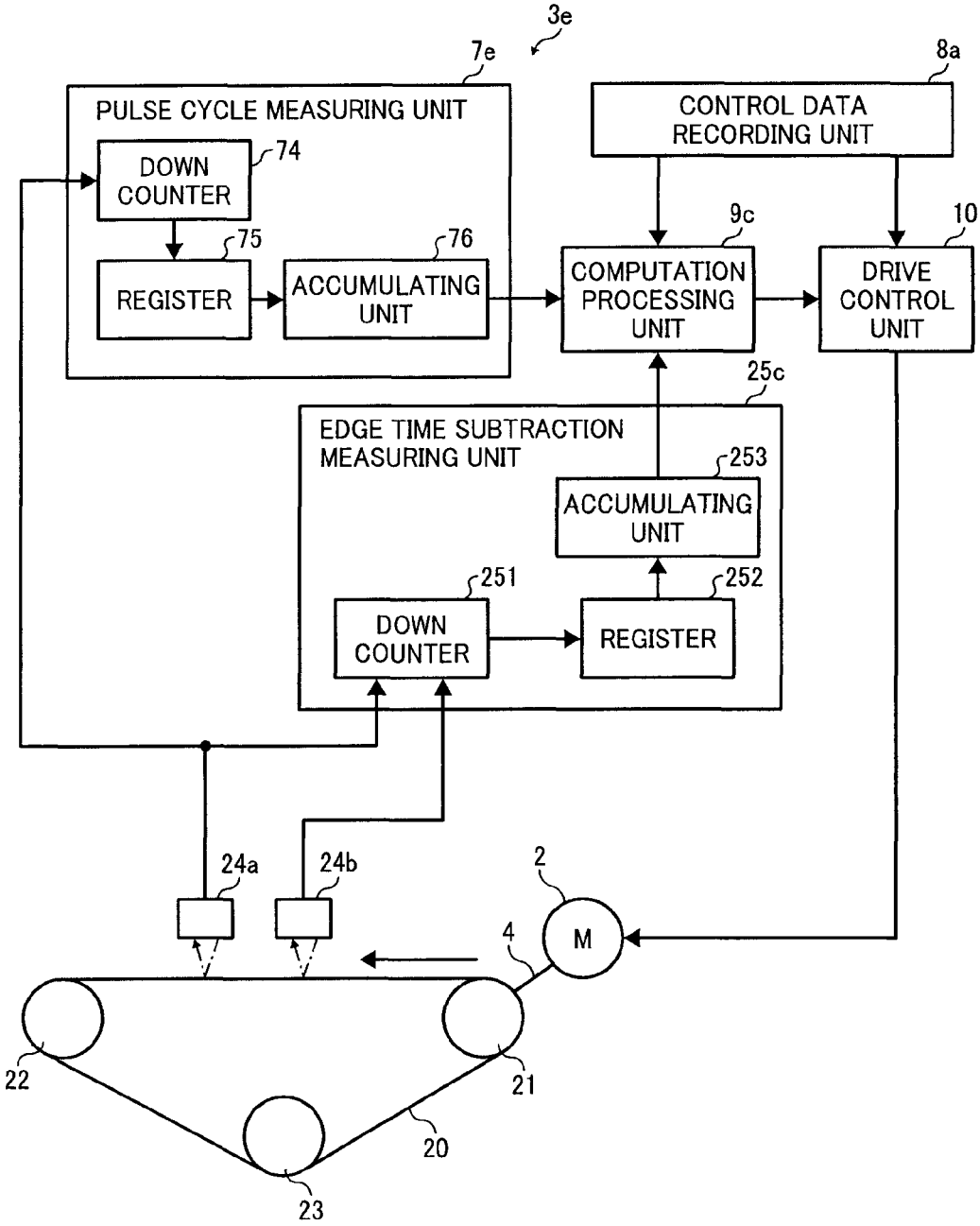
FIG. 16 is a block diagram showing another alternative embodiment of the configuration of the drive control device shown in FIG. 14 according to an embodiment of the present invention.

Further, FIG. 16 shows a block diagram for another alternative drive control device 3*e*. In this embodiment, the pulse cycle measuring unit 7*d* is modified to be a pulse cycle measuring unit 7*e* which further includes an accumulating unit 76 which accumulates data DC(n) that the register 75 receives from the down counter 74. In addition, the edge time subtraction measuring unit 25, 25*a*, or 25*b* is modified to be an edge time subtraction measuring unit 25*c*. The edge time subtraction measuring unit 25*c* includes the down counter 251, the register 252 and an accumulating unit 253.

Further, a configuration and processing of the computation processing unit 9, 9*a* and 9*b* can be simplified to be computation processing unit 9*c*.

As is noted above the computation processing unit 9, includes the pulse cycle error computation unit 11, the integrating unit 12, and the angular error computation unit 13. The computation processing unit 9*a*, includes the pulse cycle error computation unit 11, the time error correcting unit 26, the integrating unit 12 and position error computation unit 27. The computation processing unit 9*b* includes the time error correcting unit 26, the integrating unit 12, and the position error computation unit 27. The computation processing unit 9*c* includes the time error correcting unit 26 and the position error computation unit 27.

Figure 17:
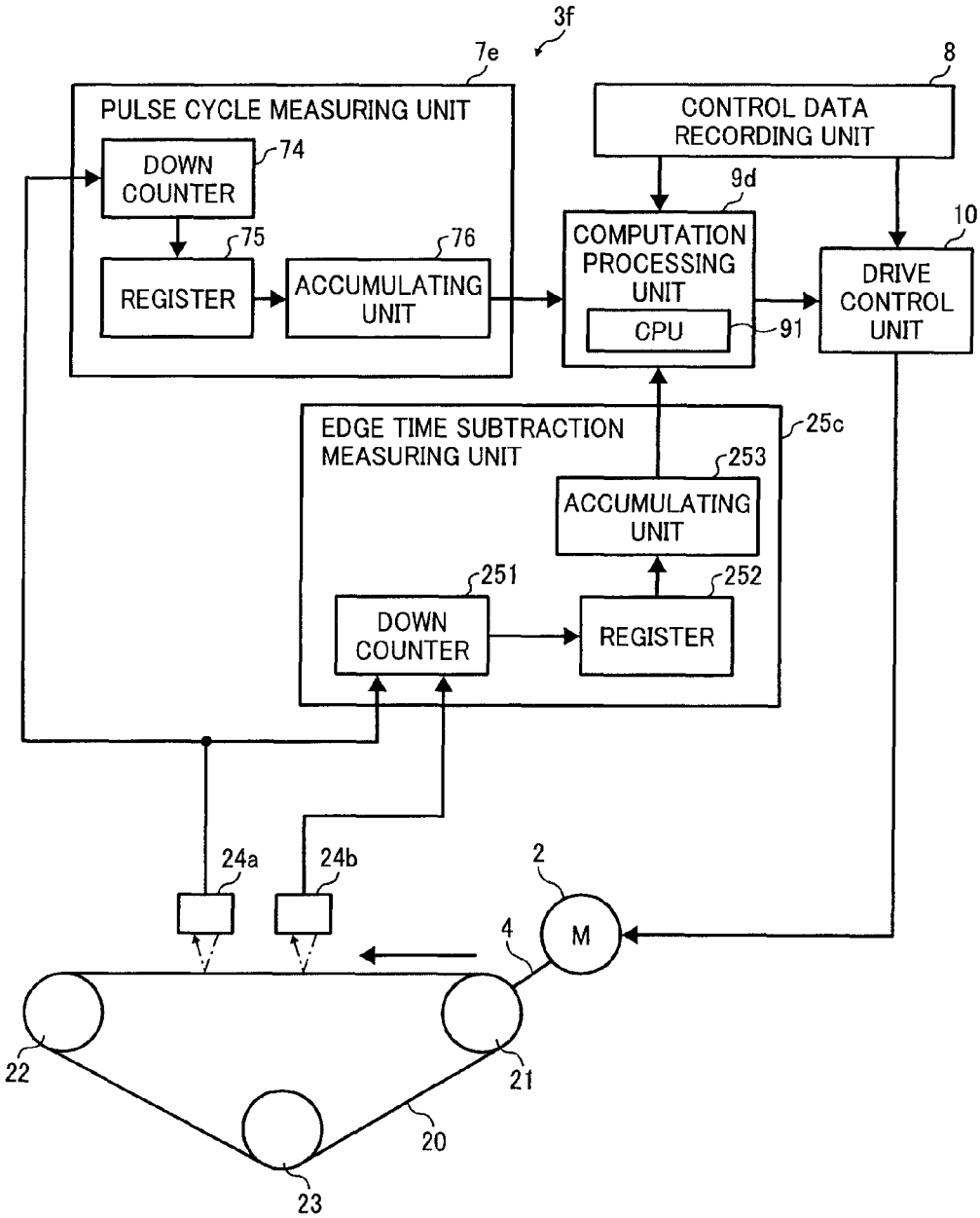
FIG. 17 is a block diagram showing another alternative embodiment of the configuration of the drive control device shown in FIG. 16 according to an embodiment of the present invention.

However, FIG. 17 shows a block diagram for the alternative drive control device 3*f*. In this alternative drive control device 3*f*, the computation processing unit 9, 9*a*, 9*b*, 9*c* is modified to be computation processing unit 9*d* which integrates a CPU 91 to calculate the position error $P_{err}$ of the endless belt 20.

When the computation processing unit 9*d* is used in place of the computation processing unit 9*a*, 9*b*, and 9*c*, the pulse cycle measuring unit 7*e* generates an interrupt processing signal which is delivered to the CPU 91 whenever the pulse cycle measuring unit 7*e* generates edge cycle data of the pulse signal received from the encoder 5 or the optical sensor 24*a*. Whenever the interrupt processing signal is generated, the CPU 91 calculates the angular error $\theta_{err}$ of the roller 1 or the position error $P_{err}$ of the endless belt 20 using edge cycle data input from the pulse cycle measuring unit 7.

Moreover, the pulse cycle measuring unit 7*e* and an edge time subtraction measuring unit 25*c* each generate an interrupt processing signal which is delivered to the CPU 91, when the pitch error of the optical markers 28 is corrected. The CPU 91 then calculates the angular error $\theta_{err}$ of the roller 1 or the position error $P_{err}$ of the endless belt 20 using the edge cycle data, the difference value ΔC, the integrated difference value from the pulse cycle measuring unit 7*e* and the edge time subtraction data or the integrated edge time subtraction from the edge time subtraction measuring unit 25*c*.

Further, when the CPU 91 computes the angular error $\theta_{err}$ of the roller 1 or the position error $P_{err}$ of the endless belt 20 using the interrupt processing signals from the pulse cycle measuring unit 7*e* or the edge time subtraction measuring unit 25*c*, a timing of the interrupt processing from the pulse cycle measuring unit 7*e* and the edge time subtraction unit 25*c* can be affected by the velocity of the endless belt 20. For example, if the velocity of the endless belt 20 was constant, then the timings of the interrupts would be almost the same. However, if the velocity is not constant, then the timings would be affected.

The computation of the angular error $\theta_{err}$ of the roller 1 or the position error $P_{err}$ of the endless belt 20 and the control processing, that includes correcting the motor instruction value, should be executed in a same cycle. However, if the computation and the control processing are not executed in a same cycle, this may cause a change in the superficial gain meaning that drive control with high accuracy may not be successfully achieved. To prevent such a disadvantageous outcome, it is preferable that the interrupt processing signal from the pulse cycle measuring unit 7*e* and the interrupt processing signal from the edge time subtraction measuring unit 25*c* be executed at a different time than the computation of the angular error $\theta_{err}$ of the roller 1 or the position error $P_{err}$ of the endless belt 20 and the drive control processing performed by CPU 91.

Figure 18:
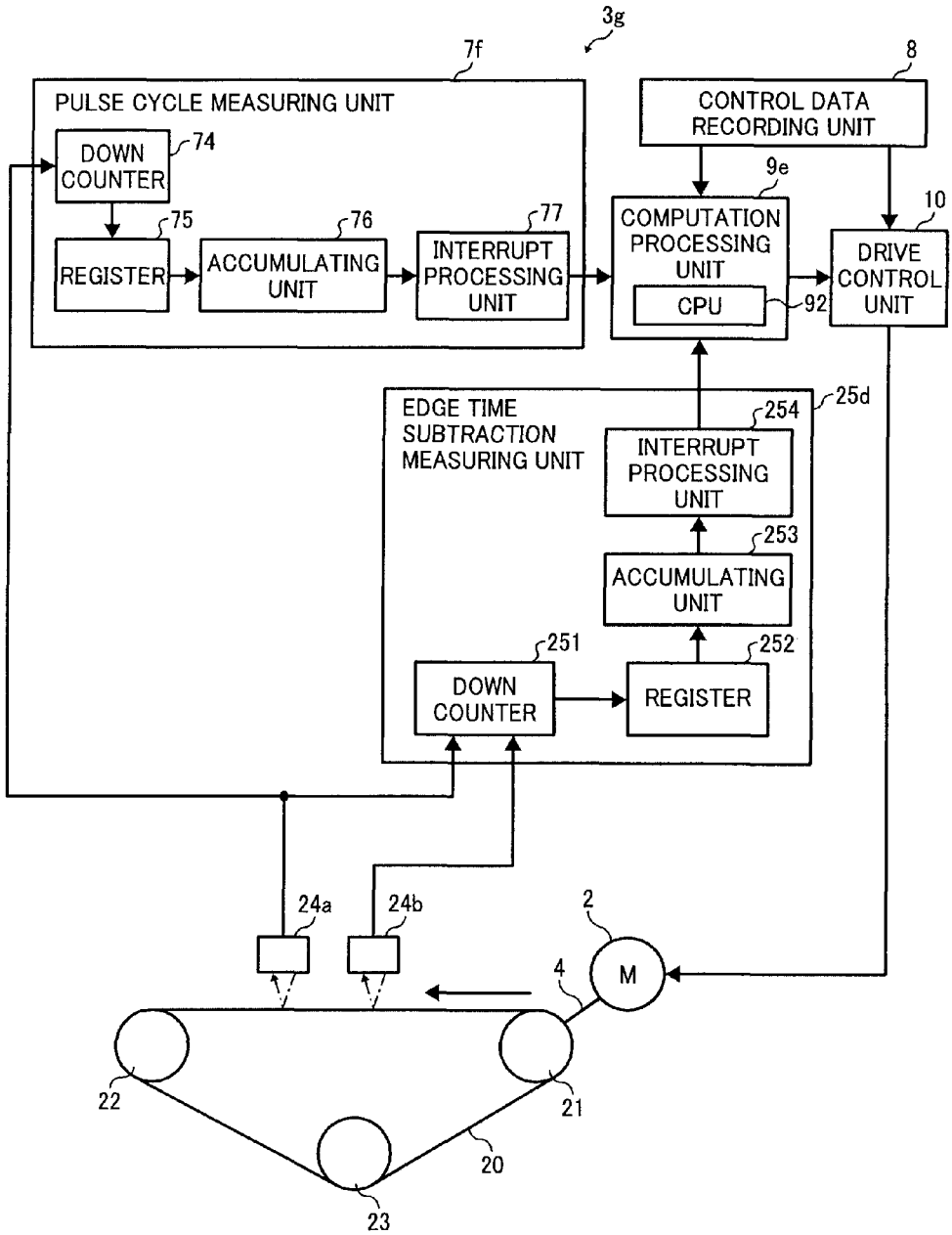
FIG. 18 is a block diagram showing another alternative embodiment of the configuration of the drive control device shown in FIG. 17 according to an embodiment of the present invention.

When the drive control, including computation processing, is executed at a different time than the interrupt processing of the pulse cycle measuring unit 7*f* and the edge time subtraction measuring unit 25*d*, both the pulse cycle measuring unit 7*f* and the edge time subtraction measuring unit 25*d* include an interrupt processing unit 77, 254 as shown in the block diagram of FIG. 18. Moreover, the drive control device 3*g* includes a computation processing unit 9*e*, and the computation processing unit 9*e* includes a CPU 92.

Figure 19A:
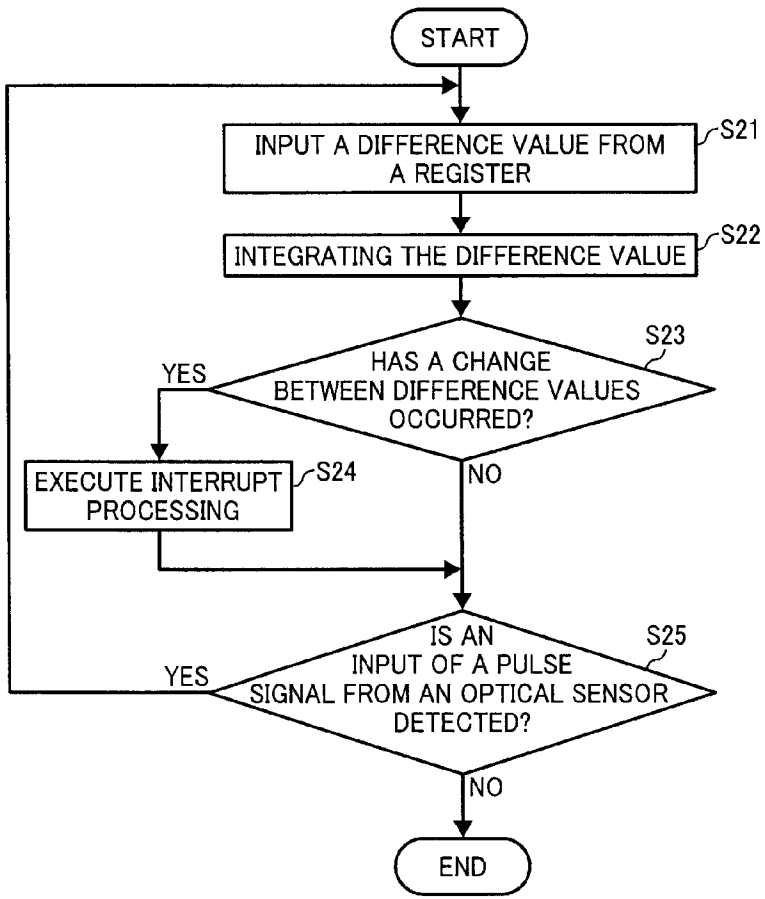
FIGS. 19A through 19B are flowcharts showing an operation of the pulse cycle measuring unit and the edge time subtraction measuring unit shown in FIG. 18 according to an embodiment of the present invention.
Figure 19B:
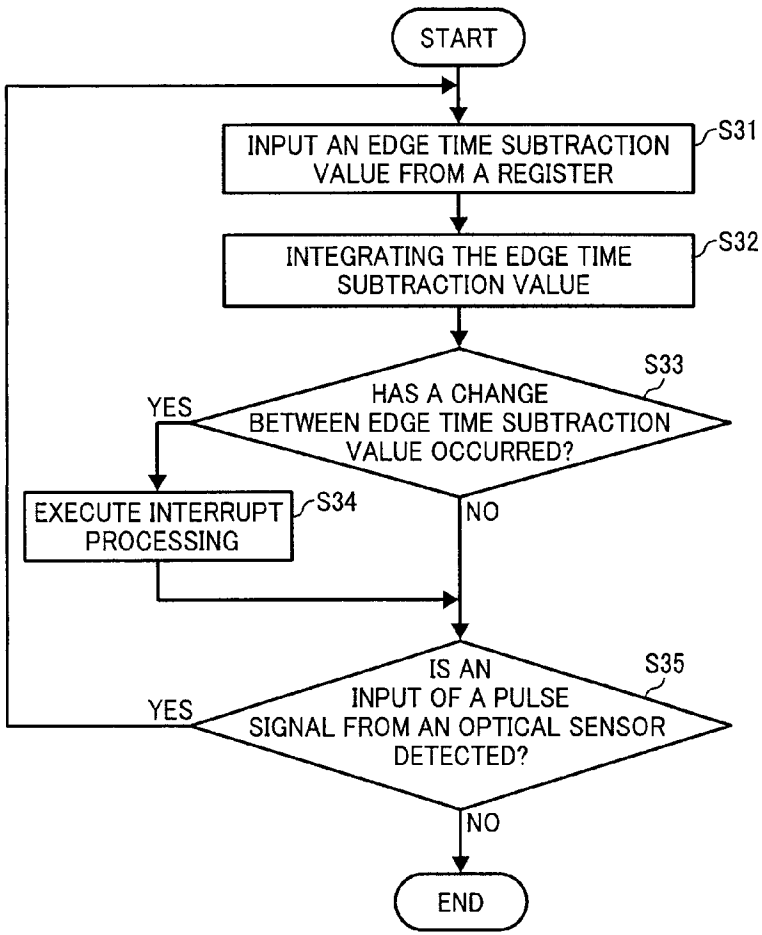

The flow chart of FIG. 19 is used to explain the interrupt processing of the pulse cycle measuring unit 7*c* and the edge time subtraction unit 25*c*.

Processing of the pulse cycle measuring unit 7*f* is explained using FIG. 19(*a*).

The pulse cycle measuring unit 7*f* outputs a difference value data ΔC whenever the down counter 74 receives the pulse signal from the optical sensor 24*a* (Step S21). The accumulating unit 76 integrates the difference value data ΔC and outputs the integrated difference value data to the interrupt processing unit 77 (Step S22). The interrupt processing unit 77 stores at least one of the integrated difference value data previously sent from the accumulating unit 76 compares the latest integrated difference value and the stored integrated difference value (Step S23).

If there is any change in the integrated difference value detected by the comparing in Step S23 (Step S23 Y), the interrupt processing unit 77 outputs the latest integrated difference value to the CPU 92 so as to start interrupt processing (Step S24) and then proceeds to Step S25.

If there is no change in the integrated difference value obtained by the comparing in Step S23 (Step S23 N), the flow proceeds to Step S25 without executing interrupt processing.

The processing from Step S21 to Step S24 is repeated whenever the pulse signal from the optical sensor 24*a* is input (Step S25).

Processing of a edge time subtraction measuring 25*d* is explained using FIG. 19(*b*).

The edge time subtraction measuring unit 25*d* outputs an edge time subtraction ph to the accumulating unit 253 whenever the down counter 74 receives the pulse signal from the optical sensors 24*a* and 24*b* (Step S31).

The accumulating unit 253 integrates the edge time subtraction ph so as to calculate an integrated edge time subtraction and outputs the integrated edge time subtraction to the interrupt processing unit 254 (Step S32). The interrupt processing unit 254 stores at least one of the previous integrated edge time subtraction values sent from the accumulating unit 253 and compares the latest integrated edge time subtraction value and the stored integrated edge time subtraction value (Step S33).

If there is any change in the integrated edge time subtraction value obtained by the comparing in Step S23 (Step S33 Y), the interrupt processing unit 254 outputs the latest integrated edge time subtraction value to the CPU 92 so as to start interrupt processing (Step S34) and the flow then proceeds to Step S35.

If there is no change in the integrated edge time subtraction value obtained by the comparing in Step S33 (Step S33 N), the flow proceeds to Step S35 without executing interrupt processing.

The processing from Step S31 to Step S34 is repeated whenever the pulse signals from the optical sensor 24*a* and 24*b* is input (Step S35).

Figure 20:
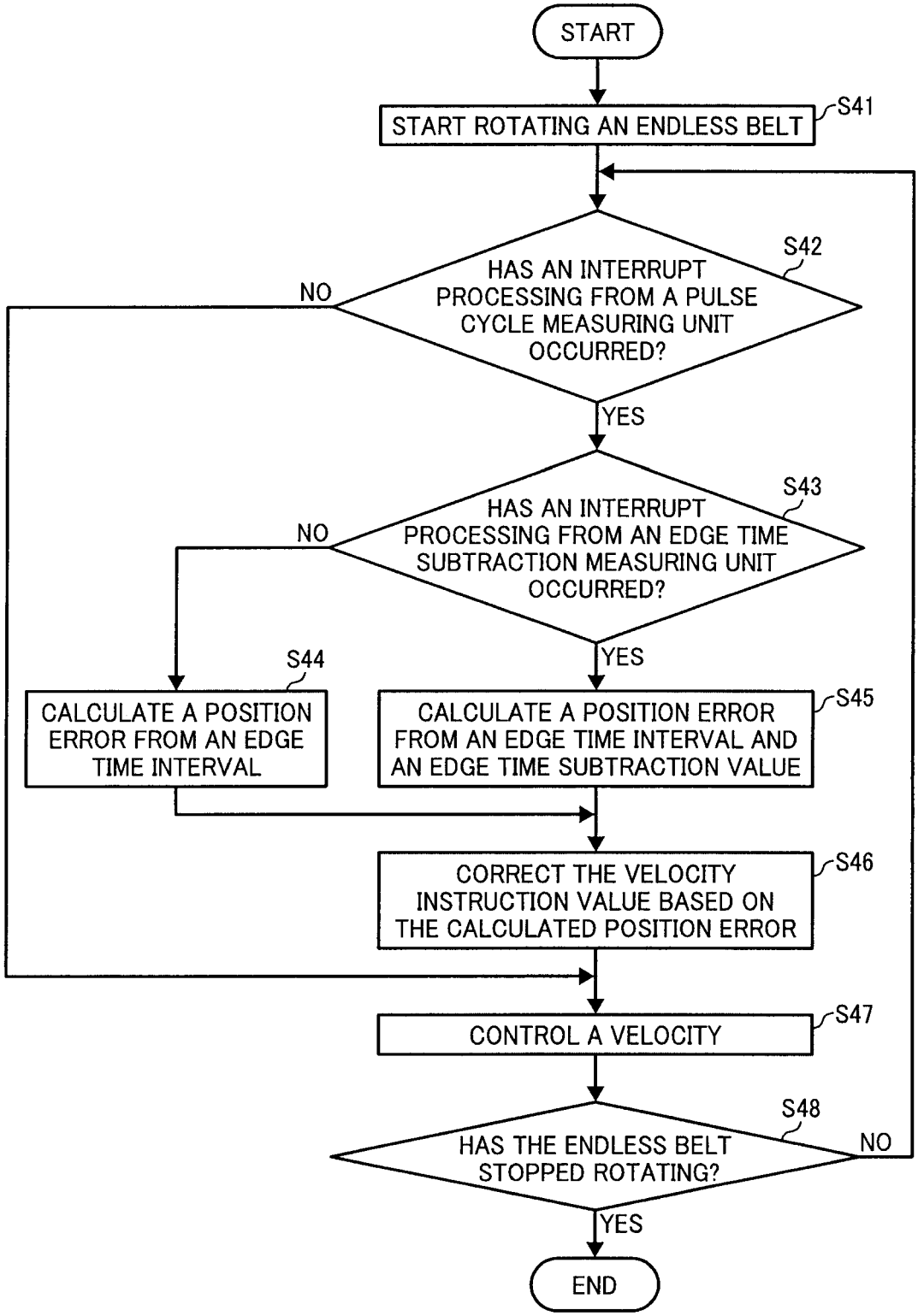
FIG. 20 is a flowchart showing an operation of the computation processing unit shown in FIG. 18 according to an embodiment of the present invention.

In the following section, a control process which includes CPU 92 computation processing is explained using the flowchart of FIG. 20.

The drive control unit 10 starts rotating the endless belt 20 at the velocity which is preset by a velocity instruction value (Step S41). The CPU 92 identifies whether an interrupt processing signal is received from the pulse cycle measuring unit 7*f* (Step S42). If no interrupt processing signal is received (Step S42 N), the CPU 92 proceeds to Step S47 without executing a computation processing to determine the position error $P_{err}$. If an interrupt signal is received (Step S42 Y), the CPU 92 identifies whether a second interrupt signal is received from the edge time subtraction unit 25*c* (Step S43).

If no second interrupt signal is received from the edge time subtraction unit 25*d* (Step S43 N), the CPU 92 proceeds to Step S44 and calculates the position error $P_{err}$ based on the difference value of edge time interval and the CPU 92 outputs the position error $P_{err}$ to the drive control unit 10 (Step S44).

In contrast, if a second interrupt signal is received from the edge time subtraction unit 25*d* (Step S43 Y), the CPU 92 proceeds to Step S45, calculates the position error $P_{err}$ based on the difference value of edge time interval and the edge time subtraction value and outputs the position error $P_{err}$ to the drive control unit 10 (Step S45).

The drive control unit 10 then corrects the velocity instruction value based on the position sensor $P_{err}$ sent from the CPU 92 (Step S46) and reads the corrected velocity instruction value from the control data recording unit 8*a*. Using this corrected velocity instruction value, the drive control unit 10 controls the velocity of the endless belt 20 (Step S47). When the velocity instruction value is corrected at Step S46, the CPU 92 stores the corrected velocity instruction value in the control data recording unit 8*a*.

The processing from Step S42 to Step S47 is repeated until the endless belt 20 stops rotating (Step S48).

In the abovementioned explanation, embodiments in which the pulse counter 70 or the pulse timer 71 is used in the pulse cycle measuring unit 7, 7*a*, 7*b*, 7*c*, 7*d*, 7*e*, or 7*f* and the edge time subtraction unit 25, 25*a*, 25*b*, 25*c*, or 25*d* are explained. Alternatively, a software timer may also used in the pulse cycle measuring unit 7, 7*a*, 7*b*, 7*c*, 7*d*, 7*e*, or 7*f* and the edge time subtraction unit 25, 25*a*, 25*b*, 25*c*, or 25*d*.

Moreover, an image forming apparatus for copying an image onto original material has been explained in the abovementioned explanation. However, the drive control unit is also applicable for a color printer or a facsimile apparatus that includes a feed belt or the like.

Figure 21:
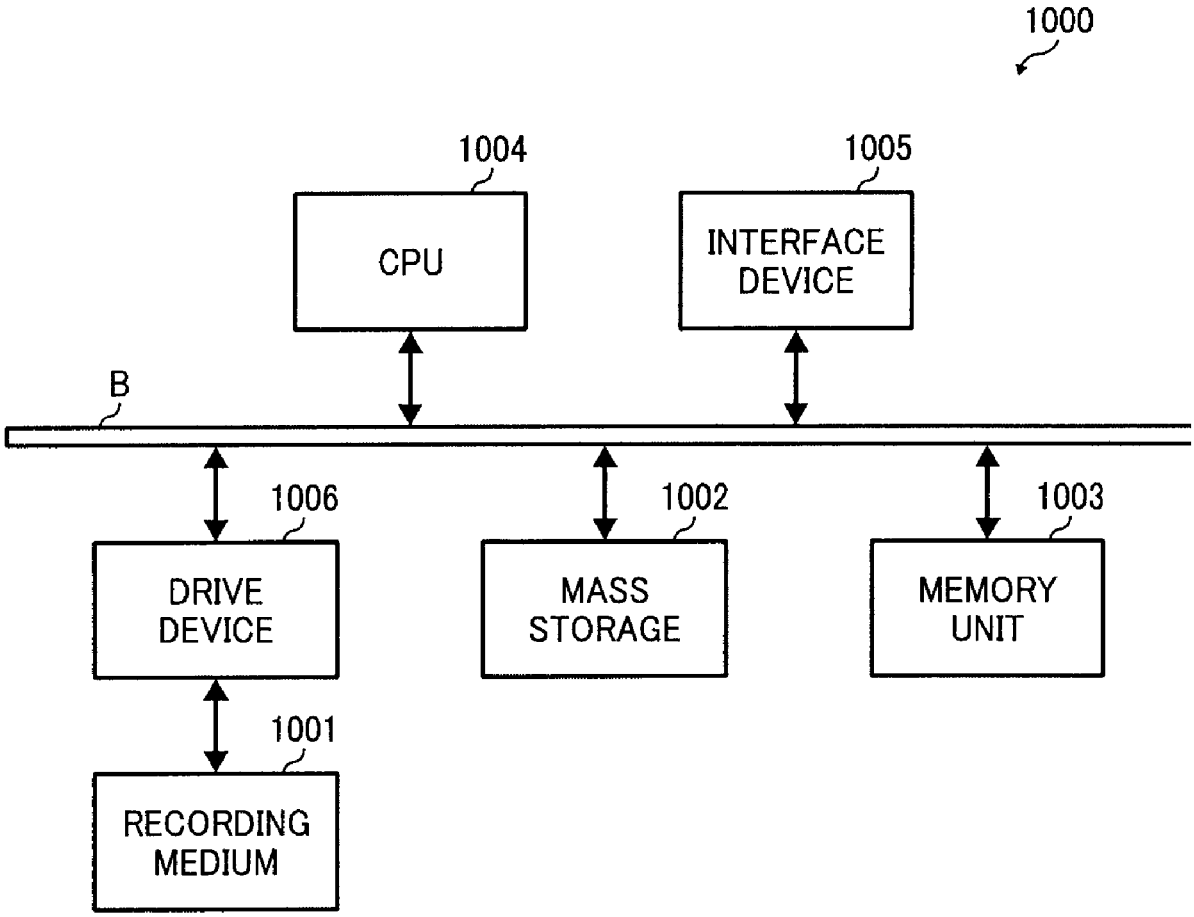
FIG. 21 is a diagram showing a configuration of an exemplary hardware.

FIG. 21 illustrates a computer system 1000 upon which an embodiment of the present invention may be implemented. The computer system 1000 includes a bus B or other communication mechanism for communicating information, and a processor/CPU 1004 coupled with the bus B for processing the information. The computer system 1000 also includes a main memory/memory unit 1003, such as a random access memory (RAM) or other dynamic storage device (e.g., dynamic RAM (DRAM), static RAM (SRAM), and synchronous DRAM (SDRAM)), coupled to the bus B for storing information and instructions to be executed by processor/CPU 1004. In addition, the memory unit 1003 may be used for storing temporary variables or other intermediate information during the execution of instructions by the CPU 1004. The computer system 1000 may also further include a read only memory (ROM) or other static storage device (e.g., programmable ROM (PROM), erasable PROM (EPROM), and electrically erasable PROM (EEPROM)) coupled to the bus B for storing static information and instructions for the CPU 1004.

The computer system 1000 may also include a disk controller coupled to the bus B to control one or more storage devices for storing information and instructions, such as mass storage 1002, and drive device 1006 (e.g., floppy disk drive, read-only compact disc drive, read/write compact disc drive, compact disc jukebox, tape drive, and removable magneto-optical drive). The storage devices may be added to the computer system 1000 using an appropriate device interface (e.g., small computer system interface (SCSI), integrated device electronics (IDE), enhanced-IDE (E-IDE), direct memory access (DMA), or ultra-DMA).

The computer system 1000 may also include special purpose logic devices (e.g., application specific integrated circuits (ASICs)) or configurable logic devices (e.g., simple programmable logic devices (SPLDs), complex programmable logic devices (CPLDs), and field programmable gate arrays (FPGAS)).

The computer system 1000 may also include a display controller coupled to the bus B to control a display, such as a cathode ray tube (CRT), for displaying information to a computer user. The computer system includes input devices, such as a keyboard and a pointing device, for interacting with a computer user and providing information to the processor. The pointing device, for example, may be a mouse, a trackball, or a pointing stick for communicating direction information and command selections to the processor and for controlling cursor movement on the display. In addition, a printer may provide printed listings of data stored and/or generated by the computer system.

The computer system 1000 performs a portion or all of the processing steps of the invention in response to the CPU 1004 executing one or more sequences of one or more instructions contained in a memory, such as the memory unit 1003. Such instructions may be read into the memory unit from another computer readable medium, such as the mass storage 1002 or a removable media 1001. One or more processors in a multiprocessing arrangement may also be employed to execute the sequences of instructions contained in memory unit 1003. In alternative embodiments, hard-wired circuitry may be used in place of or in combination with software instructions. Thus, embodiments are not limited to any specific combination of hardware circuitry and software.

As stated above, the computer system 1000 includes at least one computer readable medium 1001 or memory for holding instructions programmed according to the teachings of the invention and for containing data structures, tables, records, or other data described herein. Examples of computer readable media are compact discs, hard disks, floppy disks, tape, magneto-optical disks, PROMs (EPROM, EEPROM, flash EPROM), DRAM, SRAM, SDRAM, or any other magnetic medium, compact discs (e.g., CD-ROM), or any other medium from which a computer can read.

Stored on any one or on a combination of computer readable media, the present invention includes software for controlling the computer system 1000, for driving a device or devices for implementing the invention, and for enabling the computer system 1000 to interact with a human user. Such software may include, but is not limited to, device drivers, operating systems, development tools, and applications software. Such computer readable media further includes the computer program product of the present invention for performing all or a portion (if processing is distributed) of the processing performed in implementing the invention.

The computer code devices of the present invention may be any interpretable or executable code mechanism, including but not limited to scripts, interpretable programs, dynamic link libraries (DLLs), Java classes, and complete executable programs. Moreover, parts of the processing of the present invention may be distributed for better performance, reliability, and/or cost.

The term "computer readable medium" as used herein refers to any medium that participates in providing instructions to the CPU 1004 for execution. A computer readable medium may take many forms, including but not limited to, non-volatile media, volatile media, and transmission media. Non-volatile media includes, for example, optical, magnetic disks, and magneto-optical disks, such as the mass storage 1002 or the removable media 1001. Volatile media includes dynamic memory, such as the memory unit 1003.

Various forms of computer readable media may be involved in carrying out one or more sequences of one or more instructions to the CPU 1004 for execution. For example, the instructions may initially be carried on a magnetic disk of a remote computer. The remote computer can load the instructions for implementing all or a portion of the present invention remotely into a dynamic memory and send the instructions over a telephone line using a modem. A modem local to the computer system 1000 may receive the data on the telephone line and use an infrared transmitter to convert the data to an infrared signal. An infrared detector coupled to the bus B can receive the data carried in the infrared signal and place the data on the bus B. The bus B carries the data to the memory unit 1003, from which the CPU 1004 retrieves and executes the instructions. The instructions received by the memory unit 1003 may optionally be stored on mass storage 1002 either before or after execution by the CPU 1004.

The computer system 1000 also includes a communication interface 1005 coupled to the bus B. The communication interface 1004 provides a two-way data communication coupling to a network that is connected to, for example, a local area network (LAN), or to another communications network such as the Internet. For example, the communication interface 1005 may be a network interface card to attach to any packet switched LAN. As another example, the communication interface 1005 may be an asymmetrical digital subscriber line (ADSL) card, an integrated services digital network (ISDN) card or a modem to provide a data communication connection to a corresponding type of communications line. Wireless links may also be implemented. In any such implementation, the communication interface 1005 sends and receives electrical, electromagnetic or optical signals that carry digital data streams representing various types of information.

The network typically provides data communication through one or more networks to other data devices. For example, the network may provide a connection to another computer through a local network (e.g., a LAN) or through equipment operated by a service provider, which provides communication services through a communications network. The local network and the communications network use, for example, electrical, electromagnetic, or optical signals that carry digital data streams, and the associated physical layer (e.g., CAT 5 cable, coaxial cable, optical fiber, etc). The signals through the various networks and the signals on the network and through the communication interface 1005, which carry the digital data to and from the computer system 1000 may be implemented in baseband signals, or carrier wave based signals. The baseband signals convey the digital data as un-modulated electrical pulses that are descriptive of a stream of digital data bits, where the term "bits" is to be construed broadly to mean symbol, where each symbol conveys at least one or more information bits. The digital data may also be used to modulate a carrier wave, such as with amplitude, phase and/or frequency shift keyed signals that are propagated over a conductive media, or transmitted as electromagnetic waves through a propagation medium. Thus, the digital data may be sent as un-modulated baseband data through a "wired" communication channel and/or sent within a predetermined frequency band, different than baseband, by modulating a carrier wave. The computer system 1000 can transmit and receive data, including program code, through the network and the communication interface 1005. Moreover, the network may provide a connection to a mobile device such as a personal digital assistant (PDA) laptop computer, or cellular telephone.

What is claimed is:

1. A drive control apparatus comprising:

a drive motor configured to transmit a rotation drive force to a belt-like rotation member in order to rotate the belt-like rotation member;

a pulse signal outputting unit configured to output a pulse signal at each predetermined position on the belt-like rotation member, while the belt-like rotation member is rotating;

a pulse cycle measuring unit configured to measure a pulse cycle of the pulse signal, wherein the pulse cycle is a cycle of a rising or falling edge;

a computation processing unit configured to compute a position error of the belt-like rotation member based on the pulse cycle and a desired pulse cycle, wherein the desired pulse cycle corresponds to a desired velocity of the belt-like rotation member;

a drive control unit configured to control the drive motor based on the position error; and an edge time subtraction measuring unit, wherein the pulse signal outputting unit comprises at least two optical sensors placed along a moving direction of the belt-like rotation member at regular intervals and each of the optical sensors detects a plurality of optical markers that are arranged on the belt-like rotation member at regular intervals, and outputs a pulse signal, wherein the edge time subtraction measuring unit measures an edge time subtraction between at least two pulse signals that are output from the at least two optical sensors, and wherein the computation processing unit corrects the position error of the belt-like rotation member based on a pitch error calculated from the edge time subtraction of the at least two pulse signals and the ratio of the interval between the two optical sensors and the interval between the optical markers, wherein the computation processing unit stops computation of the position error when a pulse cycle output from one of the optical sensors indicates that a part is discontinuous, and starts computation of the position error based on the pulse signal output from the other optical sensor at the moment that the discontinuous part passes the other optical sensor, and wherein the computation processing unit stops computation of the position error by a selector being deselected, the selector being deselected in response to a counted value of an edge counter, receiving input from the at least two optical sensors, exceeding a threshold Cth, the exceeding indicating a discontinuation of the optical markers on the belt-like rotation member.

2. The drive control apparatus as claimed in claim 1, wherein the pulse cycle measuring unit includes a pulse cycle counter that counts an edge cycle of the pulse signal using a clock pulse, wherein the computation processing unit computes the position error of the belt-like rotation member based on an integrating value of the difference between the pulse cycle and the desired pulse cycle and the ratio of the desired velocity to a frequency of the clock pulse.

3. The drive control apparatus as claimed in claim 2, wherein the pulse cycle counter is a down counter that sets a desired count value corresponding to the desired velocity, wherein the computation processing unit computes the position error of the belt-like rotation member based on an integrating value derived from an output value of the down counter, the desired pulse cycle and the ratio of the desired velocity to a frequency of the clock pulse.

4. The drive control apparatus as claimed in claim 3, wherein the pulse cycle measuring unit further comprises an integrating unit that integrates the output value from the down counter in order to obtain the integrating value and stores the integrating value.

5. The drive control apparatus as claimed in claim 1, wherein the computation processing unit is comprised by a CPU that computes said position error based on the difference between the pulse cycle and the desired cycle that corresponds to the desired velocity of the belt-like rotation member, wherein the pulse cycle measuring unit generates an interrupt processing signal whenever the pulse signal that is output from the edge cycle of the pulse signal outputting unit has changed, and wherein the CPU computes the position error whenever the interrupt processing signal has been generated.

* * * * *